US008725015B2

(12) United States Patent
Kabashima

(10) Patent No.: US 8,725,015 B2
(45) Date of Patent: May 13, 2014

(54) IMAGE FORMING APPARATUS

(75) Inventor: Toru Kabashima, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 13/041,884

(22) Filed: Mar. 7, 2011

(65) Prior Publication Data

US 2011/0222880 A1 Sep. 15, 2011

(30) Foreign Application Priority Data

Mar. 12, 2010 (JP) ..... 2010-055865

(51) Int. Cl.
*G03G 15/00* (2006.01)
*G03G 15/08* (2006.01)

(52) U.S. Cl.
USPC ..... 399/44; 399/45; 399/53; 399/236

(58) Field of Classification Search
USPC ..... 399/236
See application file for complete search history.

(56) References Cited

U.S. PATENT DOCUMENTS

| | | | | |
|---|---|---|---|---|
| 6,539,183 | B2 | 3/2003 | Ishimizu et al. | |
| 6,868,246 | B2 | 3/2005 | Takeuchi et al. | |
| 6,987,941 | B2 | 1/2006 | Takeuchi et al. | |
| 2002/0076226 | A1 * | 6/2002 | Ishimizu et al. | 399/45 |
| 2004/0005407 | A1 | 1/2004 | Takeuchi et al. | |
| 2005/0147431 | A1 * | 7/2005 | Takeuchi et al. | 399/237 |

FOREIGN PATENT DOCUMENTS

| | | | |
|---|---|---|---|
| EP | 1199611 | A2 | 4/2002 |
| EP | 1199611 | A3 | 9/2004 |
| JP | 9-134106 | A | 5/1997 |
| JP | 2001-356560 | A | 12/2001 |
| JP | 2006-058586 | A | 3/2006 |
| JP | 2007171573 | A * | 7/2007 |
| JP | 2007-219077 | A | 8/2007 |
| JP | 2007-264553 | A | 10/2007 |
| JP | 2008-39967 | A | 2/2008 |
| JP | 2008-233440 | A | 10/2008 |
| JP | 2009086028 | A * | 4/2009 |
| JP | 2009237119 | A * | 10/2009 |
| JP | 5070897 | B2 | 11/2012 |

OTHER PUBLICATIONS

Machine translation of Sakado, JP 2009086028.*
Machine translation of Kanai, JP 2009237119.*
Machine translation of Takahashi et al., JP 2007-171573.*
Chinese Office Action dated Jul. 2, 2013, in related Chinese Patent Application No. 201110054235.5 (with English translation).
Notice of Reasons for Refusal dated Nov. 26, 2013, in related Japanese Patent Appln. No. 2010-055865.

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus includes: an image bearing member; a development device; a speed varying unit that can vary a speed of a developer bearing member; a sensing portion that senses an environmental temperature around the development device; and a controller that can perform a mode in which, compared with a period which an image forming region of the image bearing member passes through the developing region, the rotation speed of the developer bearing member slows down a period which a non-image forming region of the image bearing member passes through the developing region, wherein based on sensing result of the sensing portion, the controller performs the mode when the environmental temperature is higher than a predetermined value, and the controller does not perform the mode when the environmental temperature is lower than the predetermined value.

10 Claims, 12 Drawing Sheets

IMAGE FORMING APPARATUS

BACKGROUND OF THE INVENTION

1. Field of the Invention

The present invention relates to an image forming apparatus including an image bearing member and a development device that includes a developer bearing member, which can bear a developer, to visualize an electrostatic image on a surface of the image bearing member using toner borne by the developer bearing member.

2. Description of the Related Art

Recently, in the image forming apparatus such as a copying machine and a printer, it is necessary to rotate the image bearing member, the developer bearing member, and a fixing roller at a high speed in order to respond to high-speed printing that is the needs of a user. However, an amount of heat necessary to fix the toner depends on a kind of a transfer material. Therefore, sometimes image formation is performed while a gap between pieces of paper is widened, when the image formation is performed on the transfer material in which the large amount of heat is necessary to fix the toner. At this point, in one job, it is assumed that the printing is continuously performed to the transfer materials in which the large amount of heat is necessary to fix the toner. When the number of transfer materials passing through a fixing device is decreased per unit time, an electrostatic image absent region between the preceding electrostatic image and the subsequent electrostatic image is widened on the image bearing member. Therefore, the developer bearing member uselessly rotates when the developer bearing member rotates while the electrostatic image absent region moves in a position opposite the developer bearing member. The developer on the developer bearing member is degraded by the rotation of the developer bearing member, which results in degradation of image quality. For example, Japanese Patent Laid-Open No. 2007-264553 discloses an image forming apparatus in which the degradation of the image quality is suppressed. The image forming apparatus disclosed in Japanese Patent Laid-Open No. 2007-264553 includes a unit that computes a coverage rate A of image data to fix a toner ejection time t1 and a unit that computes an integrated toner ejection time (T) each time an image forming process is performed. The image forming apparatus performs a toner refresh process when the integrated value reaches a predetermined value. According to the image forming apparatus disclosed in Japanese Patent Laid-Open No. 2007-264553, even in the high-speed printing, the image quality is maintained to suppress the toner refresh process to the minimum necessary.

However, unfortunately, a down time or a consumed amount of toner that does not directly contribute to the image formation increase in the image forming apparatus of Japanese Patent Laid-Open No. 2007-264553 in which the toner refresh process is performed.

Therefore, Japanese Patent Laid-Open No. 2008-039967 discloses a configuration in which, in order to prevent the developer degradation caused by a long-term operation of the development device, the development sleeve is stopped or slows down in a region corresponding to a gap between the pieces of paper when the image is continuously formed or when an interval (gap between pieces of paper) of a non-image forming region becomes longer than usual.

However, in the configuration of Japanese Patent Laid-Open No. 2008-039967, irrespective of an environment, a rotation speed of the development sleeve slows down or stops without any exception, while the inventor found that the progression of the developer degradation is largely influenced by the environment of the apparatus. Accordingly, in the configuration of Japanese Patent Laid-Open No. 2008-039967, even in the low-temperature environment in which the developer is relatively hardly degraded, a motor of the development sleeve is turned on and off beyond necessity, unfortunately a lifetime and reliability of the motor are reduced.

SUMMARY OF THE INVENTION

An object of the present invention is to provide an image forming apparatus in which the reduction of the motor lifetime caused by switching the speed of the developer bearing member beyond necessity can be suppressed while degradation of image quality, caused by the developer degradation due to the switching of the rotation speed of the developer bearing member in the gap between the pieces of paper, is suppressed.

According to an aspect of the invention, an image forming apparatus includes: an image forming apparatus comprising: an image bearing member that bears a developer image; a development device that includes a developer bearing member, which can bear a developer, to convey the developing region of the developer bearing member facing the image bearing member and visualize an electrostatic image on a surface of the image bearing member; a transfer device that transfers a developer image on the surface of the image bearing member to a recording material; a speed varying unit that can vary a rotation speed of the developer bearing member; a sensing portion that senses an environmental temperature around the development device; and a controller that can perform a mode in which, compared with a period which an image forming region of the image bearing member passes through the developing region, the rotation speed of the developer bearing member slows down a period which a non-image forming region of the image bearing member passes through the developing region, wherein based on a sensing result of the sensing portion, the controller performs the mode when the environmental temperature around the development device is higher than a predetermined value, and the controller does not perform the mode when the environmental temperature around the development device is lower than the predetermined value.

Further features of the present invention will become apparent from the following description of exemplary embodiments with reference to the attached drawings.

DESCRIPTION OF THE EMBODIMENTS

Embodiments of the present invention will be described in detail in an exemplified manner. Dimensions, materials, shapes, relative arrangements thereof, and the like described in the following embodiments are to be appropriately modified according to a configuration of an apparatus to which the present invention is applied and various conditions. Therefore, unless otherwise specified, the scope of the present invention is not to be limited thereto. Configurations and effects of the embodiments will be described below with reference to FIGS. 1 to 8.

First Embodiment

Figure 1:
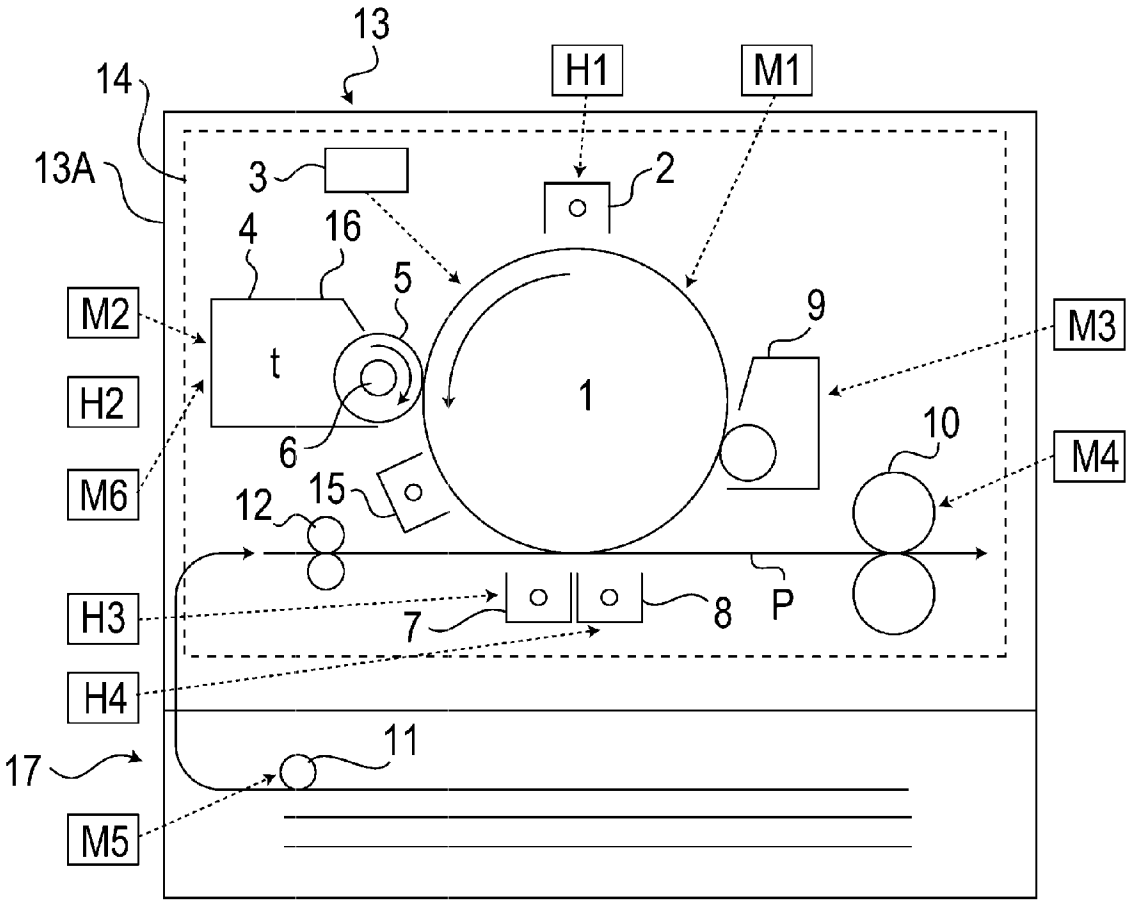
FIG. 1 is a sectional view illustrating a configuration of an image forming apparatus according to a first embodiment of the invention.

FIG. 1 is a sectional view illustrating a configuration of an image forming apparatus 13 according to a first embodiment of the present invention. The image forming apparatus 13 that is an "image input/output apparatus" has a duplex printing function in which an electrophotographic image forming process is used. As illustrated in FIG. 1, the image forming apparatus 13 includes an image forming apparatus main body (hereinafter, simply referred to as an "apparatus main body") 13A, and an image forming portion 14 is provided in the apparatus main body 13A in order to form an image in a transfer material P. The image forming portion 14 includes a photosensitive drum 1 that is an "image bearing member", and the photosensitive drum 1 rotates in an arrow direction of FIG. 1. The image forming portion 14 includes a charger 2 that is a "primary charger", an exposure device 3, a development device 4, a post-charger 15, a transfer charger 7, a separating charger 8, and a cleaning device 9 around the photosensitive drum 1. The development device 4 includes a development sleeve that is a "developer bearing member". The development sleeve 5 conveys the developing region of the developer bearing member facing the bearing member. The development sleeve 5 can bear a developer t, and an electrostatic image on a surface of the photosensitive drum 1 is visualized with the developer t borne by the development sleeve 5. The development device 4 includes a magnet roller 6 that constitutes a rotation center of the development sleeve 5 and a regulating member 16 that regulates a layer thickness of the developer t on the surface of the development sleeve 5. The transfer charger 7 that is a "transfer device" transfers a developer image on the surface of the photosensitive drum 1 to the transfer material P. The image forming portion 14 includes a fixing device 10 that is a "fixing device" on an upstream side of the photosensitive drum 1 and the separating charger 8 in a conveying direction of the transfer material P. The image forming apparatus 13 includes a paper feed portion 17 that feeds the transfer material P to the image forming portion 14. The paper feed portion 17 includes a feed roller 11 that feeds the transfer material P and a registration roller 12 that adjusts a position of the transfer material P. The numerals M1 to M5 and H1 to H4 are described below with reference to FIG. 2.

Figure 2:
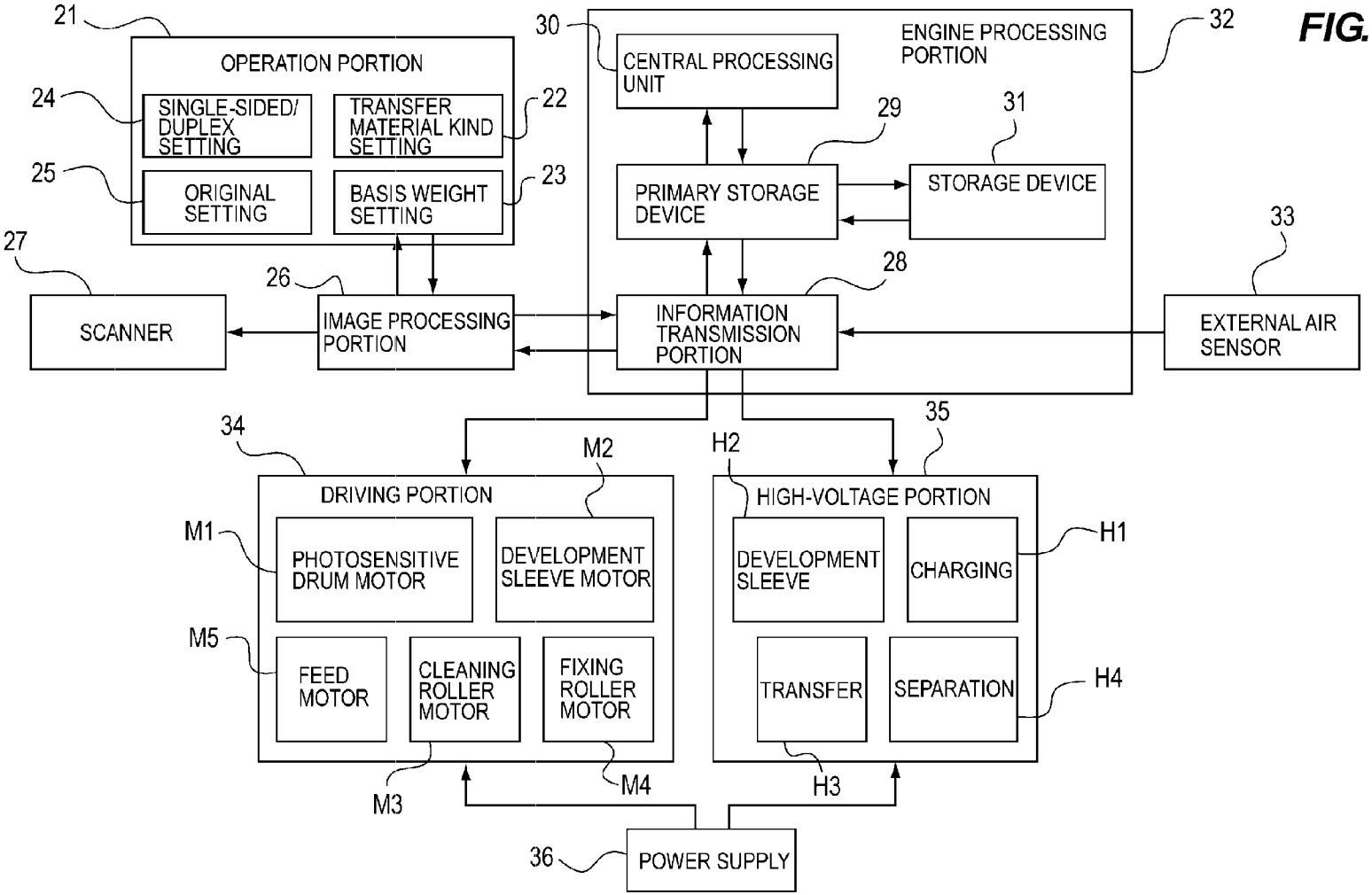
FIG. 2 is a block diagram illustrating signal transmission of the image forming apparatus.

FIG. 2 is a block diagram illustrating signal transmission of the image forming apparatus 13. As illustrated in FIG. 2, the image forming apparatus 13 includes various electric processing portions that operate internal instruments of the apparatus main body 13A of the image forming apparatus 13. The image forming apparatus 13 mainly includes an engine processing portion 32, an external air sensor 33 that is an "external air sensing portion" constituting an "external air detecting unit", an operation portion 21, an image processing portion 26, a scanner 27, a driving portion 34, a high-voltage portion 35, and a power supply 36.

The engine processing portion 32 that is a "speed varying unit" constituting a "controller" (described below) can change a rotation speed of the development sleeve 5. Irrespective of a kind of the transfer material P, the engine processing portion 32 adjusts the rotation speed of the development sleeve 5 while keeping (maintaining) the rotation speed of the photosensitive drum 1. When a basis weight of the transfer material P is larger than a predetermined value, the engine processing portion 32 reduces the rotation speed of the development sleeve 5 in a non-development time when an electrostatic image absent region of the photosensitive drum 1 is not developed by the developer lower than the rotation speed of the development sleeve 5 in a development time when the electrostatic image of the photosensitive drum 1 is developed by the developer. The engine processing portion 32 is a controlling portion that can perform the above-described mode.

Referring to FIG. 2, the engine processing portion 32 is a part that processes electric information of the image forming apparatus 13, and includes a central processing unit 30, a primary storage device 29, a storage device 30, and an information transmission portion 28 that is an "information transmission unit". Based on the basis weight of the transfer material P, the central processing unit 30 that is a "speed condition computing unit" included in the engine processing portion 32 that is the "speed varying unit" computes the time the rotation speed of the development sleeve 5 is decreased and a decreasing amount of the rotation speed of the development sleeve 5.

The external air sensor 33 senses temperature and humidity around the image forming apparatus 13, and is disposed in a position where the external air sensor 33 is hardly influenced by heat of the image forming apparatus 13. The operation portion 21 that is an "input portion" can perform an original setting 25 in which a user performs printing, a transfer material kind setting 22, a basis weight setting 23, and a single-sided/duplex setting 24 that is a print mode. Generally, the operation portion 21 is disposed near the image forming apparatus 13 and in a position where the user easily operates the operation portion 21.

Information on the "basis weight" of the transfer material P is input in the basis weight setting 23 of the operation portion 21. Information on "smoothness" of the transfer material P is input in the transfer material kind setting 22 of the operation portion 21. "Transfer surface number information on the number of surfaces of the duplex or single-sided transfer material P subjected to the transfer" is input in the single-sided/duplex setting 24 of the operation portion 21. Sometimes the information on the "basis weight", the information on the "smoothness", and the "transfer surface number information on the number of surfaces of the duplex or single-sided transfer material P subjected to the transfer" can be recognized as information indicating heat capacity.

The image processing portion 26 processes image information from the operation portion 21. The scanner 27 transfers image data to the exposure device 3. The engine processing portion 32 transmits electric signals for a driving motor, that is, feed motor M5, a photosensitive drum motor M1, a development sleeve motor M2, a cleaning roller motor M3, a fixing roller motor M4, and the like to the driving portion 34 to operate the internal instruments of each image forming portion 14. The engine processing portion 32 transmits high-voltage signals of development sleeve H2, charging H1, transfer H3, separation H4, and the like to the high-voltage portion 35. The power supply 36 supplies voltages of 3.3 V, 5 V, 24 V, and the like to the driving portion 34, the high-voltage portion 35, the engine processing portion 32, and the operation portion 21 through electric wiring (not illustrated).

For example, when the transfer material P passes through the registration roller 12, a transfer material passing sensor (not illustrated) senses a leading end (front side) and a rear end (rear side) of the transfer material P. The engine processing portion 32 receives the sensing result of the transfer material passing sensor to compute the times that the leading end and the rear end of the transfer material P pass through the transfer portion. According to the times, the engine processing portion 32 computes a time that the electrostatic image is formed on the surface of the photosensitive drum 1, a time the electrostatic image is developed by the developer, and a time the developer image passes through the transfer portion. Accordingly, the engine processing portion 32 can recognize times that an electrostatic image part (image region) between the leading end and the rear end of the preceding transfer material P and a non-electrostatic-image part (non-image region) between the rear end of the preceding transfer material P and the leading end of the subsequent transfer material P pass between the development sleeve 5 and the photosensitive drum 1. Therefore, the engine processing portion 32 drives the high-voltage portion 35 to apply a development bias to the development sleeve 5 in synchronization with the times the electrostatic image part and the non-electrostatic-image part pass by the development sleeve 5.

Figure 3:
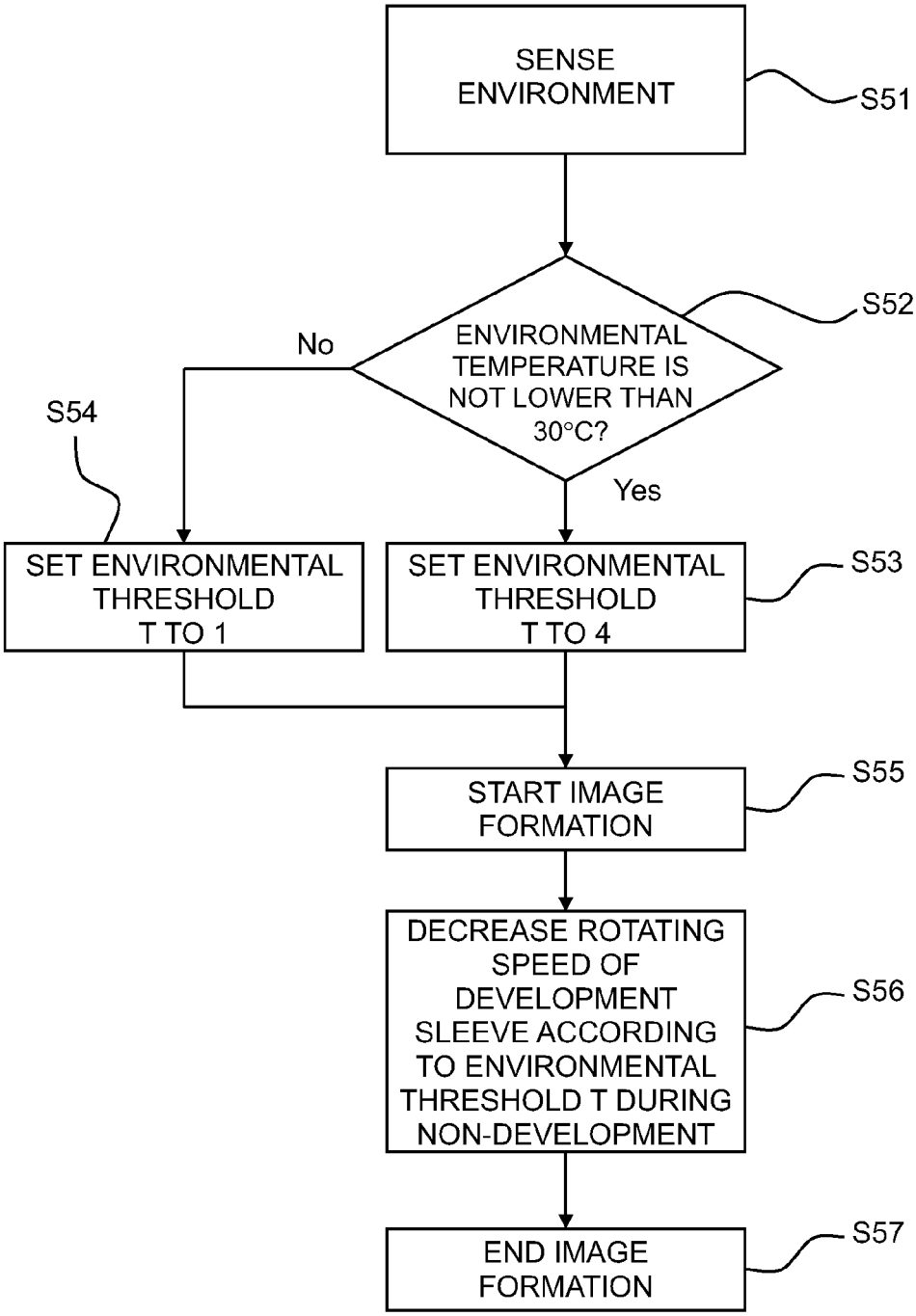
FIG. 3 is a flowchart illustrating a control process of an engine processing portion.

FIG. 3 is a flowchart illustrating a control process of the engine processing portion 32 included in the image forming apparatus 13 of the first embodiment. In the first embodiment, the rotation speed of the development sleeve 5 is reduced based on the temperature and humidity in an environment in which the image forming apparatus 13 is installed.

Specifically, the image forming apparatus 13 of the first embodiment has the following features. The image forming apparatus 13 includes the external air sensor 33 that is the "external air sensing portion" constituting the "environmental temperature sensing unit" and the engine processing portion 32 that is the "speed varying unit". The external air sensor 33 senses the environmental temperature around the development device 4. The engine processing portion 32 can vary the rotation speed of the development sleeve 5. Irrespective of the kind of the transfer material P, the engine processing portion 32 adjusts the rotation speed of the development sleeve 5 while keeping (maintaining) the rotation speed of the photosensitive drum 1. When the environmental temperature of the development device 4 is higher than a predetermined value, the engine processing portion 32 reduces the rotation speed of the development sleeve 5 in the non-development time when the electrostatic image absent region of the photosensitive drum 1 is not developed by the developer lower than the rotation speed of the development sleeve 5 in the development time when the electrostatic image of the photosensitive drum 1 is developed by the developer.

The external air sensor 33 of FIG. 2 senses the environmental temperature and the environmental humidity. The sensing result is transferred to the information transmission portion 28 and the primary storage device 29. Preferably, the external air sensor 33 is disposed in the image forming apparatus 13 and in the position close to the external air.

When the external air sensor 33 senses the environmental temperature and the environmental humidity, the engine processing portion 32 starts the control (S51). For example, the engine processing portion 32 determines whether the environmental temperature is not lower than 30° C. (S52). When determining that the environmental temperature is not lower than 30° C. (YES in S53), the engine processing portion 32 sets an environmental threshold T to 4 (S53). When determining that the environmental temperature is lower than 30° C. (NO in S53), the engine processing portion 32 sets an environmental threshold T to 1 (S54). When the environmental threshold is set to 4 or 1, the engine processing portion 32 computes the rotation speed of the development sleeve 5 in the non-development time based on the set environmental threshold T.

TABLE 1 shows a relationship among the environmental temperature, the environmental threshold T, and the reduction of the rotation speed of the development sleeve 5 in the non-development time. The central processing unit 30 fixes the rotation speed of the development sleeve 5 in the non-development time from the data of the sensed temperature. The developer t is easily degraded with increasing environmental temperature, because the temperature in the apparatus main body 13A rises. Therefore, the rotation speed of the development sleeve 5 in the non-development time is reduced.

TABLE 1

| | ENVIRONMENTAL TEMPERATURE ° C. | | | |
|---|---|---|---|---|
| | LOWER THAN 20° C. | NOT LOWER THAN 20° C. AND LOWER THAN 25° C. | NOT LOWER THAN 25° C. AND LOWER THAN 30° C. | NOT LOWER THAN 30° C. |
| ENVIRONMENTAL THRESHOLD (T) | 1 | 2 | 3 | 4 |
| COMPARATIVE EXAMPLE 1 | ABSENCE | ABSENCE | ABSENCE | ABSENCE |
| FIRST EMBODIMENT | ABSENCE | SMALL | INTERMEDIATE | LARGE |

When the environmental threshold is set to 4 or 1, the engine processing portion 32 starts the image formation based on the set environmental threshold T (S55). The engine processing portion 32 performs the control so as to reduce the rotation speed of the development sleeve 5 in the non-development time based on the environmental threshold T of the environmental temperature (S56). The engine processing portion 32 ends the image formation (S57).

TABLE 2 shows experimental results of an image forming apparatus according to a comparative example 1 and the image forming apparatus of the first embodiment. The experimental results show that, for the environmental temperature of 30° C., a variation in reflecting density under the high-temperature environment can be suppressed in the first embodiment because the rotation speed is reduced. The similar results are obtained in the below-described embodiments. The number of passing transfer materials is 100 kImage. In TABLE 4, Δ (delta) means a ratio of the rotation speed of the development sleeve 5 of the non-development time to the development time. The reflecting density of the image (solid patch) through which the transfer material P is passing is measured with a density meter (X-rite). In the reflecting density, "○" is not lower than 1.40, "Δ" ranges from 1.30 to 1.40, "x" ranges from 1.20 to 1.30, "xx" ranges from 1.00 to 1.20, and "xxx" is lower than 1.00. The variation in reflecting density is maximum and minimum values of the reflecting density per 10 k. In the density difference, "○○" is equal to or lower than 0.05, "○" ranges from 0.10 to 0.05, "Δ" ranges from 0.20 to 0.10, and "x" is not lower than 0.20. The evaluations of "○○" to "xxx" are similar to those of first to fifth embodiments.

TABLE 2

| | | CONTROL | | RESULT VARIATION IN REFLECTING DENSITY (PER 10 kIMAGE) |
|---|---|---|---|---|
| | CONDITION ENVIRONMENTAL TEMPERATURE | REDUCTION OF ROTATION SPEED OF DEVELOPMENT SLEEVE (Δ) | EXTERNAL AIR SENSOR | |
| COMPARATIVE EXAMPLE 1 | 19° C. | ABSENCE | ABSENCE | ○ |
| | 30° C. | ABSENCE | ABSENCE | x |
| FIRST EMBODIMENT | 19° C. | ABSENCE | PRESENCE | ○ |
| | 30° C. | PRESENCE (LARGE) | PRESENCE | ○ |

Figure 4A:
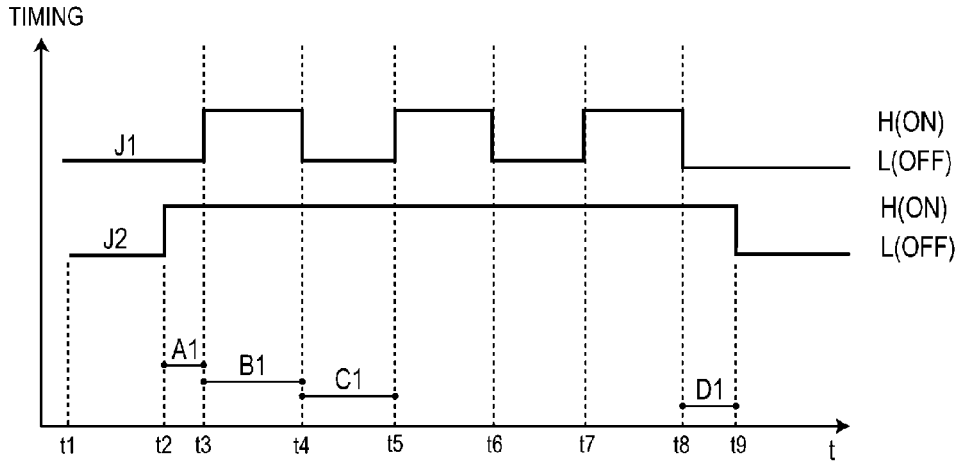
FIG. 4 is a view illustrating driving states of a photosensitive drum and a development sleeve from start of image formation to ending of image formation.

FIG. 4A is a graph illustrating driving states of the photosensitive drum 1 and the development sleeve 5 from the start of the image formation (S55) to the ending of the image formation (S57) of FIG. 3, when the image is continuously formed on plural pieces of plain paper (the environmental temperature is lower than 30° C.). A line J1 in FIG. 4A indicates whether the image forming apparatus 13 is in the development time or the non-development time. The signal of H (high value) indicates the state in which the development device 4 performs the development to the electrostatic image of the photosensitive drum 1. As used herein, the "state in which the development device 4 performs the development" means that the image forming region (image region corresponding to the transfer material P) on the photosensitive drum 1 is passing through the development region where the photosensitive drum 1 and the development sleeve 5 face each other.

On the other hand, the signal of L (low value) indicates the non-development time when the non-image region corresponding to the gap between the transfer materials P adjacent to each other in the region of the photosensitive drum 1 is passing through the development region. A time interval from the ending of the development of the preceding electrostatic image (t4) to the start of the development of the subsequent electrostatic image (t5) corresponds to the non-development time.

A line J2 in FIG. 4A is a development sleeve driving signal. When the driving signal is H (high value), the engine processing portion 32 controls the driving portion 34 to set the rotation speed of the development sleeve 5 to a high speed (normal speed).

On the other hand, in the line J2, when the driving signal is L (low value), the engine processing portion 32 controls the driving portion 34 to set the rotation speed of the development sleeve 5 to a low speed (lower than the normal speed).

The actual operation, particularly the operations of the development sleeve 5 in each step will mainly be described below. Because the operations such as the exposure, the charging, the transfer, and the paper feed of the engine processing portion 32, the driving portion 34, and the high-voltage portion 35 are similar to those of the conventional technique, the description will not be repeated. The rotation speed of the photosensitive drum 1 is kept constant irrespective of the kind of the transfer material.

FIG. 4A illustrates the graph when the engine processing portion 32 performs the control by the arithmetic processing such that the rotation speed of the development sleeve 5 in the non-development time becomes equal to the rotation speed of the development sleeve 5 in the development time. At a time t1, the engine processing portion 32 starts the image formation (see S5 of FIG. 3), and the engine processing portion 32 starts the rotation of the photosensitive drum 1, the application of the charging bias, and drive of the cleaning device 9.

At a time t2, the engine processing portion 32 starts the rotation of the development sleeve 5.

At a time t3, the engine processing portion 32 adjusts the development bias signal of the development device 4 to H (ON) to start the first development of the surface of the photosensitive drum 1. That is, for the continuous job in which the plural images are formed, the development of the first image is started. The engine processing portion 32 applies a voltage of the power supply 36 to the development sleeve 5 in proper timing by the signal from the development sleeve H2.

At a time t4, the engine processing portion 32 adjusts the development bias signal of the development device 4 to L (OFF) to end the first development of the surface of the photosensitive drum 1. A development period B1 from the time t3 to the time t4 corresponds to the "development time" when the electrostatic image is developed by the developer t. Accordingly, the development time means a period during which the development device 4 develops the electrostatic image of the photosensitive drum 1.

At a time t5, the engine processing portion 32 adjusts the development bias signal of the development device 4 to H (ON) to start the second development of the surface of the photosensitive drum 1. A non-development period C1 from the time t4 to the time t5 corresponds to the "non-development time" when the electrostatic image absent region is not developed by the developer t. Accordingly, the non-development time means a period during which the development device does not develop the electrostatic image absent region of the photosensitive drum 1. The similar graph is formed from the time t5 and later.

Because the environmental temperature is lower than 30° C., the rotation speed of the development sleeve 5 in the non-development time is set to H (ON) identical to that of the rotation speed of the development sleeve 5 in the development time.

For the plain paper, because the gap between the pieces of paper is shorter than that of thick paper, it is not particularly necessary to reduce the rotation speed of the development sleeve 5 even in the non-development time. Therefore, the rotation speed of the development sleeve 5 is not reduced for the low environmental temperature (lower than 30° C.). The development sleeve 5 is still driven during a speed reduction preparing period D1 after the final developer image is formed. Then, at a time t9, the drive of the development sleeve 5 is stopped. The development bias is turned off at the same time.

Figure 4B:
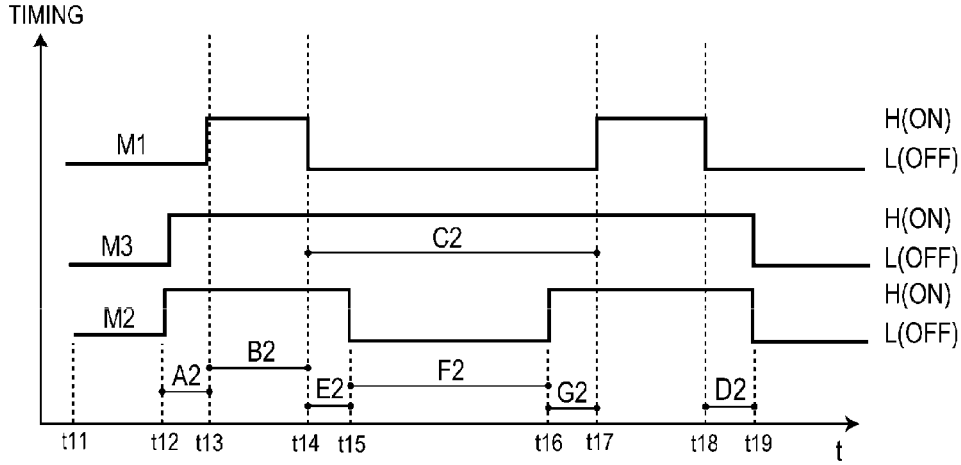

FIG. 4B is a graph illustrating the driving state of the development sleeve 5 when the images are continuously formed on the plain paper (at the environmental temperature of not lower than 30° C.). FIG. 4B illustrates the time the electrostatic image of the photosensitive drum 1 is developed by the developer and the times the rotation speed of the development sleeve 5 changed for the comparative example 1 and the first embodiment. Because H (ON) and L (OFF) are similar to those of FIG. 4A, the description will not be repeated. That is, a line K1 in FIG. 4B whether the image forming apparatus 13 is in the development time or the non-development time, and the line K1 corresponds to the line J1 of FIG. 4A. Lines K2 and K3 in FIG. 4B are driving signals of the development sleeve. At a time t11, the engine processing portion 32 starts the image formation (see S5 of FIG. 3), and the engine processing portion 32 starts the rotation of the photosensitive drum 1, the application of the charging bias, and drive of the cleaning device 9.

At a time t12, the engine processing portion 32 starts the rotation of the development sleeve 5.

At a time t13, the engine processing portion 32 starts the first development of the surface of the photosensitive drum 1. That is, for the continuous job in which the plural images are formed, the development of the first image is started. The engine processing portion 32 applies a voltage of the power supply 36 to the development sleeve 5 in proper timing by the signal from the development sleeve H2.

At a time t14, the engine processing portion 32 adjusts the development bias signal of the development device 4 to L (OFF) to end the first development of the surface of the photosensitive drum 1. A development period B2 from the time t13 to the time t14 corresponds to the "development time" when the image region corresponding to the transfer material P in the region of the photosensitive drum 1 passes through the development sleeve 5. Accordingly, the development time means a period during which the development device 4 develops the electrostatic image of the photosensitive drum 1.

At a time t17, the engine processing portion 32 adjusts the driving signal of the development device to H (ON) to start the second development of the surface of the photosensitive drum 1. A non-development period C2 from the time t14 to the time t17 corresponds to the "non-development time" when the non-image region, which is in the region of the photosensitive drum 1, corresponding to that gap between the transfer materials P adjacent to each other passes through the development sleeve 5. Accordingly, the non-development time means a period during which the development device 4 does not develop the electrostatic image of the photosensitive drum 1. During the period from the time t14 to the time t17, the development sleeve performs different operations in the comparative example 1 (line K3) and the first embodiment (line K2). For the comparative example 1 (line K3), the rotation speed of the development sleeve 5 in the non-development time does not change according to the environmental temperature during the period from the time t14 to the time t17. That is, for the comparative example 1, the operation is identical to that of the environmental temperature lower than 30° C. during the period from the time t14 to the time t17. On the other hand, for the first embodiment (line K2), the rotation speed of the development sleeve 5 in the non-development time changes according to the environmental temperature during the period from the time t14 to the time t17, particularly during a period from a time t15 to a time t16. That is, the rotation speed of the development sleeve 5 is reduced. At this point, the development sleeve 5 may be stopped or the rotation speed of the development sleeve 5 may slow down. The rotation speed of the development sleeve 5 is controlled according to the signal from the engine processing portion 32.

In the first embodiment, the rotation speed of the photosensitive drum 1 is kept constant irrespective of the environmental temperature. The reason will be described below. For the high environmental temperature, the amount of heat necessary for the fixing is increased because of the large heat capacity. Therefore, there is a method for reducing the rotation speed of the photosensitive drum 1 to obtain the heat amount. However, when the environmental temperature rapidly changes, it is necessary that the rotation speed of the photosensitive drum 1 be changed and restarted while the image formation is tentatively stopped in the middle of the development operation. As a result, an output time is increased to decrease the productivity. In order to suppress the degradation of the productivity, the rotation speed of the photosensitive drum 1 is kept constant irrespective of the environmental temperature of the transfer material P.

When the rotation speed of the photosensitive drum 1 (and the drive of the charger 2 and the drive of the cleaning device 9) is changed, as described above, the output time is increased and the productivity is decreased. On the other hand, because the rotation speed of the development sleeve 5 is rapidly changed, advantageously the increase of the output time and the decrease of the productivity are not generated, and the degradation of the developer can be suppressed.

The invention can also be applied to the case in which the plural process speeds are prepared according to the kind of paper. For the thick paper, the effect of the invention is obtained when the rotation speed of the development sleeve 5 is reduced in the non-development time.

Referring to FIG. 4B, in the non-development time, the non-development period C2 in the case that the environmental temperature is not lower than 30° C. (in the case of second embodiment, the case of the thick paper is equivalent) becomes about three times the non-development period C1 (see FIG. 4A) in the case that the environmental temperature is lower than 30° C. (in the case of second embodiment, the case of the plain paper is equivalent). The rotation speed of the development sleeve 5 during the non-development period C2, particularly during a low-speed rotation period F2. The rotation of the development sleeve 5 is started at a time t16 that is earlier than a time t17 the second development is started by a speed-up preparing period G2. This is because a time is necessary to reach a predetermined speed since the signal is transmitted to the motor. A motor characteristic is described below.

Figure 4C:
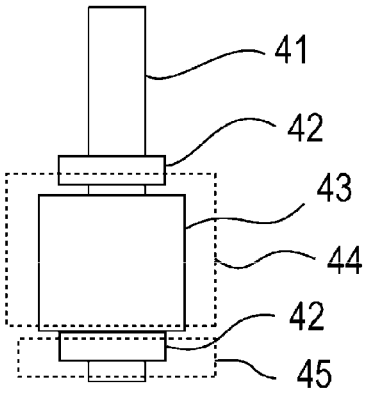

FIG. 4C is a sectional view illustrating a configuration of the development driving motor 40 that drives the development sleeve 5. The development driving motor 40 will be described with reference to FIG. 4C. Examples of the driving motor include a DC motor, a brushless motor, and a stepping motor. The power supply includes a direct-current (DC motor) power and an alternating-current (AC) power, and examples of the AC motor include a single-phase motor and a three-phase motor. A motor rotating method is classified into a synchronous fashion and an induction fashion. Recently, a permanent-magnet DC motor is frequently used. The development driving motor 40 has the following configuration. A voltage is applied to a lead from the power supply. A rotor 43 is rotated by a stator 44 to transmit a power to a shaft 41, thereby driving the development driving motor 40. The rotor 43 is fixed by a bearing 42. The stator 44 is fixed by a bracket 45. A principle in which the stator 44 (power supply) is converted into the rotor 43 (torque) can be classified into an electromagnetic motor in which a magnetic field and a current are used, an electrostatic motor in which an electric field phenomenon is used, and an ultrasonic motor. In such motors, frictional heat is generated when the rotor 43 is converted into a force. We can feel the motor is heated when touching the motor. Particularly, when the drive is started, that is, when the speed of the motor is enhanced, a large amount of energy is consumed. At this point, the energy except the energy used in the power (rotation energy) of the shaft 41 becomes thermal energy to consume the rotor 43 or the stator 44. For example, when the development driving motor 40 breaks down, because the electrostatic image cannot be visualized by the developer t, the image forming apparatus 13 is stopped to lead to a service call. The user feels uncomfortable because the user cannot use the image forming apparatus 13 for a longer time.

It is necessary to decrease the number of driving start times as many as possible in order that the malfunction of the motor is prevented to suppress the degradation of the developer. When the change in the driving speed is decreased, the malfunction of the development driving motor 40 can be suppressed while power consumption is decreased.

It is necessary to fix the stopping of the development driving motor 40 according to the non-development time. The non-development time is compared with the time the development driving motor 40 is stopped or the time until the development driving motor 40 is stabilized since the drive of the development driving motor 40 is started. When the former is longer than the latter, the effect that the development driving motor 40 is stopped is not obtained too much. For example, it is assumed that the time of 100 ms is necessary to stop the development driving motor 40, and it is assumed that the time of 100 ms is necessary to stabilize the development driving motor 40 since the drive of the development driving motor 40 is started. At this point, the development driving motor 40 is hardly stopped when the non-development time is not lower than 200 ms. In such cases, possibly, the influence on the malfunction of the development driving motor 40 becomes larger rather than the effect generated by the low speed in the non-development time.

According to the image forming apparatus 13 of the first embodiment, the engine processing portion 32 that is the "speed varying unit" reduces the rotation speed of the development sleeve 5 in the "non-development time" lower than the rotation of the development sleeve 5 in the "development time" when the environmental temperature of the transfer material P is higher than the predetermined value. Accordingly, the toner refresh period is shortened to reduce the consumed amount of toner, and the time the development sleeve 5 rotates while the toner is not consumed is shortened, thereby suppressing the image quality degradation caused by the toner degradation. As a result, the fixing characteristic of the developer t with respect to the transfer material P and the image quality of the print are maintained for a long time.

At the same time, the engine processing portion 32 that is the "speed varying unit" keeps (maintains) the rotation speed of the photosensitive drum 1 constant irrespective of the environmental temperature (in the case of second embodiment, the kind of the transfer material P is equivalent). When the image formation is performed to the plural transfer materials P at different environmental temperatures, the decrease of the print productivity is suppressed because the rotation speed of the photosensitive drum 1 is kept constant. When the image formation is performed to the transfer material P at a high environmental temperature, the decrease of the rotation speed of the photosensitive drum 1 decreases the print productivity.

Second Embodiment

Figure 5:
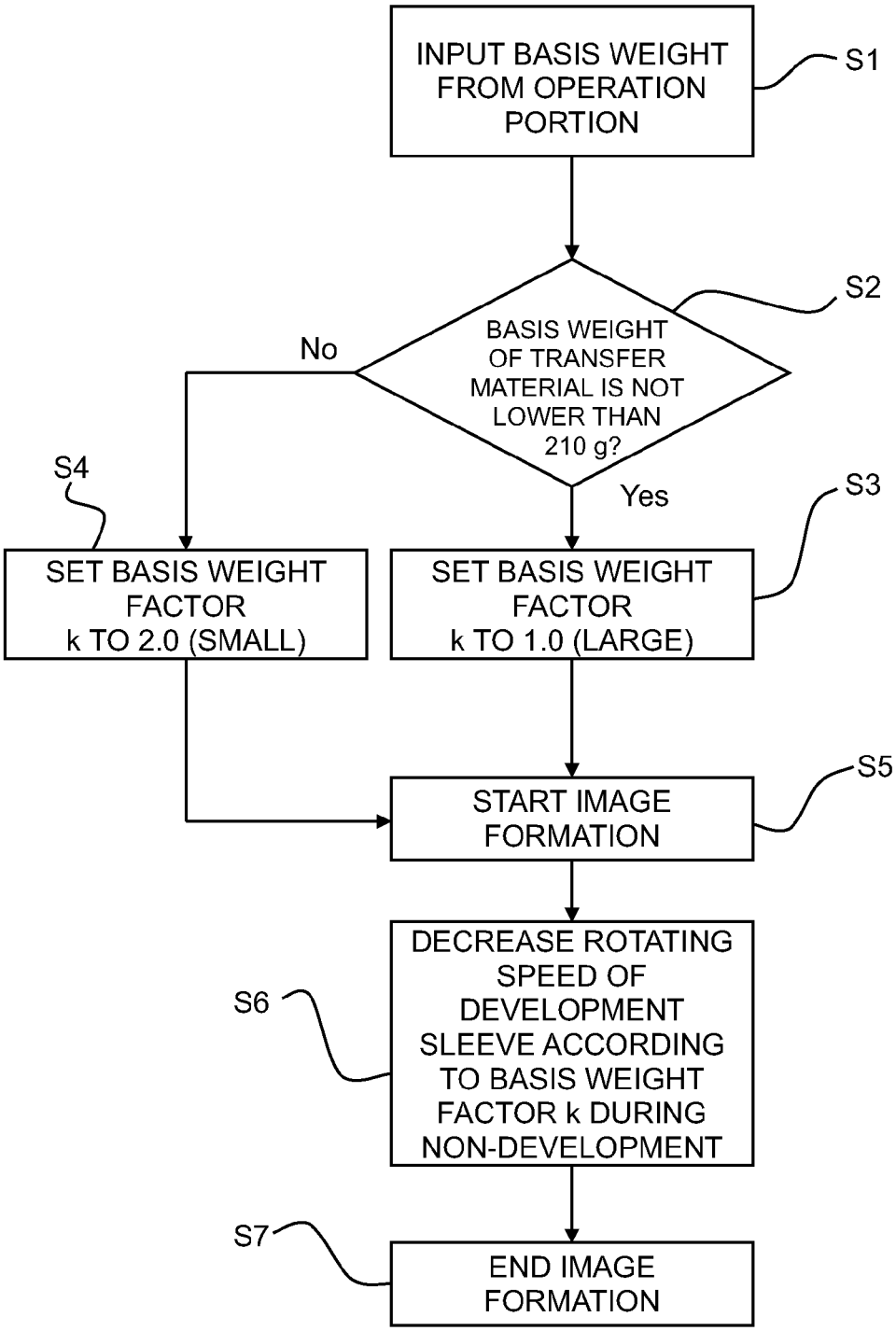
FIG. 5 is a flowchart illustrating control timing of an engine processing portion of an image forming apparatus according to a second embodiment of the invention.

FIG. 5 is a flowchart illustrating a control process of an engine processing portion 32 according to a second embodiment of the invention. When the user selects the basis weight of the transfer material P, the engine processing portion 32 delays the rotation of the development sleeve 5 in the non-development time for the large basis weight of the transfer material P. The signal transmission and reception will be described with reference to a flowchart of FIG. 5 in addition to the sectional view of the image forming apparatus of FIG. 1 and the block diagram of the signal transmission of FIG. 2. The image forming operation is described below.

When the user inputs the basis weight of the transfer material P by the basis weight setting 23 (see FIG. 2) from the operation portion 21, the engine processing portion 32 starts the control (S1). The engine processing portion 32 determines whether the basis weight of the transfer material P is not lower than 210 g/cm$^2$ (S2). When determining that the basis weight of the transfer material P is not lower than 210 g/cm$^2$ (YES in S2), the engine processing portion 32 sets a basis weight factor k to 1.0 (large) (S3). When determining that the basis weight of the transfer material P is lower than 210 g/cm$^2$ (NO in S2), the engine processing portion 32 sets the basis weight factor k to 2.0 (small) (S4).

The engine processing portion 32 transmits the information on the basis weight factor k to the image processing portion 26, the information transmission portion 28, and the primary storage device 29 (see FIG. 2). At the same time, the engine processing portion 32 causes the central processing unit 30 to perform the computation based on the input value, and the engine processing portion 32 computes the rotation speed of the development sleeve 5 (see FIG. 2).

TABLE 3 shows a relationship among the basis weight of the transfer material P, the basis weight factor k, and the reduction of the rotation speed of the development sleeve 5 in the non-development time. At this point, it is assumed that the case in which the number of rotations of the development sleeve 5 in the non-development time is decreased by 25% compared with the number of rotations of the development sleeve 5 in the development time is expressed by "small". It is assumed that the case in which the number of rotations of the development sleeve 5 in the non-development time is decreased by 50% compared with the number of rotations of the development sleeve 5 in the development time is expressed by "intermediate". It is assumed that the case in which the number of rotations of the development sleeve 5 in the non-development time is decreased by 75% compared with the number of rotations of the development sleeve 5 in the development time is expressed by "large". The engine processing portion 32 produces the control signal such that the rotation speed of the development sleeve 5 is largely reduced in the non-development time with increasing basis weight of the transfer material P. Because the heat capacity is generally increased with increasing basis weight of the transfer material P, preferably the rotation speed of the development sleeve 5 is also reduced with increasing basis weight of the transfer material P.

TABLE 3

| | BASIS WEIGHT g/m² | | | |
|---|---|---|---|---|
| | LOWER THAN 100 g/m² | NOT LOWER THAN 100 g/m² AND LOWER THAN 200 g/m² | NOT LOWER THAN 200 g/m² AND LOWER THAN 300 g/m² | NOT LOWER THAN 300 g/m² |
| BASIS WEIGHT FACTOR (k) | 1 | 2 | 3 | 4 |
| COMPARATIVE EXAMPLE 1 | ABSENCE | ABSENCE | ABSENCE | ABSENCE |
| SECOND EMBODIMENT | ABSENCE | SMALL | INTERMEDIATE | LARGE |

When the basis weight factor k is set to 2.0 or 1.0, the engine processing portion 32 starts the image formation based on the set basis weight factor k (S5). The usual rotation speed of the development sleeve 5 is stored in the storage device 31 and computed by the central processing unit 30 through the primary storage device 29. The signal of the computed rotation speed of the development sleeve 5 in the non-development time is transmitted to the driving portion 34 through the information transmission portion 28. The signal is transmitted to the development sleeve motor M2 to control the rotation speed of the development sleeve 5. The engine processing portion 32 performs the control based on the basis weight factor k of the transfer material P so as to reduce the rotation speed of the development sleeve 5 (S6). The engine processing portion 32 ends the image formation (S7).

TABLE 4 compares the variation in reflecting density under the conditions of the basis weight of the transfer material P, the reduction of the rotation speed of the development sleeve 5, and the presence or absence of the transfer material kind sensor, when the image forming apparatus of the comparative example 2 and the image forming apparatus of the second embodiment are used. The effect of the image forming apparatus 13 having the above-described configuration and action will be described below with reference to TABLE 4. In the comparative example 2, the rotation speed of the development sleeve 5 is kept constant irrespective of the basis weight of the transfer material P. In the second embodiment, the rotation speed of the development sleeve 5 is reduced according to the basis weight of the transfer material P.

TABLE 4

| | CONDITION BASIS WEIGHT g/m² | CONTROL: REDUCTION OF ROTATION SPEED OF DEVELOPMENT SLEEVE (Δ) | CONTROL: ENVIRONMENTAL TEMPERATURE | RESULT VARIATION IN REFLECTING DENSITY (PER 10 kIMAGE) |
|---|---|---|---|---|
| COMPARATIVE EXAMPLE 2 | 64 | ABSENCE | ABSENCE | ○ |
| | 210 | ABSENCE | ABSENCE | x |
| SECOND EMBODIMENT | 64 | ABSENCE | PRESENCE | ○ |
| | 210 | PRESENCE (INTERMEDIATE) | PRESENCE | ○ |

As shown in TABLE 4, in the comparative example 2, the reflecting density largely varies at the basis weight of 210 g/cm². This is attributed to the following fact. That is, because the developer t is not consumed in the non-development time, a charging imparting agent in the developer is peeled off or buried to degrade the developer t, thereby decreasing the reflecting density. On the other hand, in the second embodiment, the variation in reflecting density is decreased at the basis weight of 210 g/cm². This is attributed to the fact that the rotation speed of the development sleeve 5 is reduced to suppress the degradation of the developer t and therefore the reflecting density is stabilized.

As to the experimental conditions, the productivity is 135 ppm (plain paper of 64 g/cm²), the image ratio to output is performed at duty of 5%, and the basis weight of the transfer material P is 64 g/cm² or 210 g/cm². In addition, the experimental environment is set to the environmental temperature of 28° C. and the environmental humidity of 70% in the continuous duplex paper passage test in the transfer material passing mode, and the number of passing transfer materials is 100 kImage. The reduction of the rotation speed of the development sleeve 5 is set to "intermediate" (50%).

The timing charts of FIGS. 4A and 4B will be described below. For the plain paper (64 g/cm²), 135 pieces of paper pass per minute. The non-development period C1 is set to 150 ms. A speed-up preparing period A1 during which the rotation of the development sleeve 5 is started before the beginning of the development is set to 100 ms, and a development period B1 is set to 315 ms. The speed reduction preparing period D1 is equal to the speed-up preparing period A1.

On the other hand, for the thick paper (basis weight of 210 g/cm²), the non-development period C2 is set to 615 ms. A speed-up preparing period A2 during which the rotation of the development sleeve 5 is started from the beginning of the development and a development period B2 are equal to the speed-up preparing period A1 and the development period B1 for the plain paper. A low-speed rotation period F2 during which the development sleeve 5 rotates at a low speed in the non-development period is set to 414 ms. A speed reduction preparing period E2 is set to 100 ms, and the speed-up preparing period G2 is set to 100 ms. That is, in the second embodiment, the speed reduction of 414 ms is performed per one piece of paper compared with the comparative example 1. The development sleeve 5 rotates at a lower speed by about 67% in terms of ratio. The speed reduction time of the development sleeve 5 is lengthened to prevent the degradation of the developer t, which allows the variation in reflecting density to be suppressed.

The rotation of the development sleeve 5 and the degradation of the developer t will be described below. The surface of the development sleeve 5 is coated with the predetermined amount of developer t by the regulating member 16. A cylindrical magnet roller 6 made of the permanent magnet is incorporated in the development sleeve 5 while tied up. The developer t on the surface of the development sleeve 5 is conveyed to the photosensitive drum 1 by a conveying force of the rotation of the development sleeve 5, and the electrostatic image is visualized by the developer t. In the non-development time, it is not necessary to visualize the electrostatic image, the developer t on the surface of the development sleeve 5 is retained. As a result, the developer t passes by the regulating member 16 many times, and an external additive in the surface of the developer t is peeled off or buried in the developer t. Therefore, the charging amount does not reach a predetermined value, and the density is decreased. In the development sleeve 5, the magnet roller 6 is retained by a bearing (not illustrated). When the development sleeve 5 rotates while the magnet roller is fixed, the frictional heat is generated between the bearing and the magnet roller 6. The generated heat is transferred to the developer t to change the resin in the developer t, the charging performance is lowered, and the developer t is degraded.

Not only the degradation of the developer t and the decrease in density are generated by the heat in the development sleeve 5, but also the inside of the apparatus main body 13A and the external air temperature are influenced by the heat. When the environmental temperature rises by 10° C. in the installation site of the image forming apparatus 13, the developer temperature also rises by 10° C. When the basis weight of the transfer material P is increased by 100 g, the developer temperature rises by 2° C. This is because the temperature of the fixing device 10 rises to satisfy the fixing characteristic when the basis weight of the transfer material P is increased. The developer temperature rises by 2° C. in the duplex printing mode in which the transfer material P once passing through the fixing device 10 re-enters the apparatus main body 13A. This is because the inside of the apparatus main body 13A is filled with the heat included in the transfer material P. The developer temperature rises when the transfer material P having the high fixing temperature, such as the thick paper and coated paper whose surface is smoothed, enters the apparatus main body 13A after once passing through the fixing device 10.

In order to prevent the degradation of the developer t, it is necessary to stop the drive of the development sleeve 5 as much as possible. When the drive of the development sleeve 5 is decreased for all the kinds of the transfer material P, the lifetime of the motor is shortened and the power consumption is increased. Therefore, the drive of the development sleeve 5 is controlled to the minimum necessary. Particularly, when the transfer material P has the large basis weight in which the time necessary to prepare the heat amount for the fixing device 10 (for example, thick paper), it is necessary to increase the distance between the transfer materials P. Therefore, the effectively the drive of the development sleeve 5 is decreased. In the second embodiment, the driving speed of the development sleeve 5 is reduced only when the transfer material P has the large basis weight.

The non-development time is lengthened when the transfer material P has the large basis weight. This is attributed to the following fact. That is, when the transfer material P has the large basis weight, because it takes a long time for the fixing device 10 to accumulate the heat amount after the heat amount is imparted to the transfer material P, it is necessary to set a longer time until the toner is fixed to the subsequent transfer material P after the toner is fixed to the preceding transfer material P. When the transfer material P has the large basis weight, the fixing temperature is set slightly higher than that of the plain paper. Therefore, an atmospheric temperature of the development device tends to become higher than that of the plain paper. As a result, the developer of the development device comes up against the severer status. In the second embodiment, when the transfer material P has the large basis weight, the driving speed of the development sleeve 5 is reduced lower than that of the plain paper.

The time necessary for the fixing device 10 to prepare the heat amount imparted to the transfer material P is shortened when the transfer material P has the small basis weight. Accordingly, the fixing temperature of the plain paper is set lower than that of the thick paper. In the continuous image formation, the plain paper is narrower than the thick paper in the interval between the preceding transfer material and the subsequent transfer material (gap between pieces of paper).

In the second embodiment, when the thick paper and the thin paper are used while mixed, the rotation speed of the development sleeve 5 is set to the usual process speed in both the development time and the non-development time immediately before the thin-paper image is developed. When the thick paper and the thin paper are used while mixed, the rotation speed of the development sleeve 5 in the non-development time is set lower than that in the development time immediately before the thick-paper image is developed. Alternatively, an operator may select whether a developer degradation mode (sleeve gap-between-pieces-of-paper low-speed mode) is applied to the transfer materials having the identical kind (for example, the pieces of thick paper having the identical kind). In the second embodiment, the rotation speed of the development sleeve 5 is reduced by way of example. Alternatively, the development sleeve may be stopped.

Third Embodiment

Figure 6:
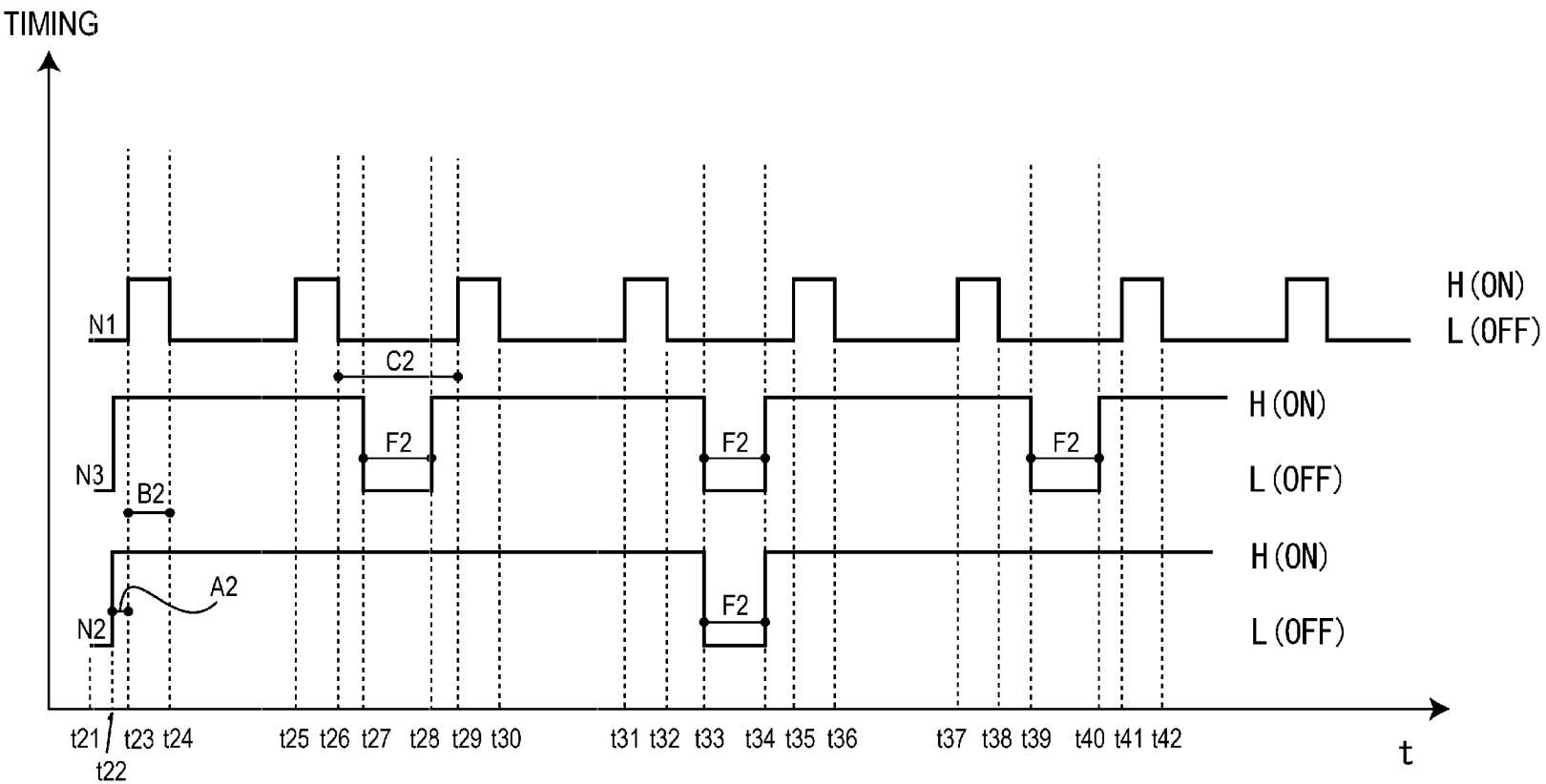
FIG. 6 is a timing chart illustrating a control process of an engine processing portion of an image forming apparatus according to a third embodiment of the invention.

FIG. 6 is a timing chart illustrating a control process of an engine processing portion 32 of an image forming apparatus according to a third embodiment of the invention. A line N1 expresses both the development time and the non-development time. A line N2 and a line N3 express the driving signal of the development sleeve. In the image forming apparatus of the third embodiment, the same configuration and effect as those of the image forming apparatus 13 of the first and second embodiments are designated by the same numerals, and the description will not be repeated. The image forming apparatus of the third embodiment differs from the image forming apparatus of the first and second embodiments in that the number of times at which the rotation speed of the development sleeve 5 in the non-development time is increased.

In the third embodiment, the time the rotation speed of the development sleeve 5 in the non-development time is reduced is optimized when the basis weight of 210 g/cm$^2$ of the transfer material P is selected by the operation portion 21. In the second embodiment, the rotation speed of the development sleeve 5 in the non-development time is reduced in each four pieces of paper (see line N2). In the third embodiment, the rotation speed of the development sleeve 5 in the non-development time is reduced in each two pieces of paper. The third embodiment is equal to the second embodiment in the low speed (see line N3). TABLE 5 compares the variation in reflecting density under the conditions of the basis weight of the transfer material P, the reduction of the rotation speed of the development sleeve 5, and the presence or absence of the transfer material kind sensor, when the pieces of image forming apparatus of the second embodiment, the third embodiment, and the third embodiment 3b are used. As shown in TABLE 5, in the image forming apparatus of the third embodiment, the variation in reflecting density is smaller than that of the image forming apparatus 13 of the second embodiment. That is, for the identical rotation speed of the development sleeve 5, the variation in reflecting density is decreased with increasing frequency at which the rotation speed of the development sleeve 5 is reduced.

TABLE 5

| | CONTROL | | RESULT |
|---|---|---|---|
| | REDUCTION OF ROTATION SPEED OF DEVELOPMENT SLEEVE (Δ) | REDUCTION TIMING OF ROTATION SPEED OF DEVELOPMENT SLEEVE | VARIATION IN REFLECTING DENSITY (PER 10 kIMAGE) |
| SECOND EMBODIMENT | PRESENCE (INTER-MEDIATE) | IN EACH FOUR PIECES OF PAPER | Δ |
| THIRD EMBODIMENT | PRESENCE (INTER-MEDIATE) | IN EACH TWO PIECES OF PAPER | ○○ |
| THIRD EMBODIMENT 3b | PRESENCE (SMALL) | IN EACH FOUR PIECES OF PAPER | ○○ |

In the third embodiment, because the experimental conditions are similar to those of the second embodiment, only the different point will be described. In the third embodiment 3b, the rotation speed of the development sleeve 5 is reduced by 25%, and the rotation speed of the development sleeve 5 is reduced in each four pieces of paper. In the third embodiment, the rotation speed of the development sleeve 5 is reduced by 50%, and the rotation speed of the development sleeve 5 is reduced in each two pieces of paper. Therefore, the similar experimental results are obtained in the third embodiment 3b and the third embodiment.

The reason will be described below. The developer t is degraded earlier as the number of times at which the developer t passes by the regulating member 16. The degradation of the developer t is promoted with increasing rotation speed of the development sleeve 5. The number of times at which the developer t passes by the regulating member 16 is increased per unit time with increasing rotation speed of the development sleeve 5. As the number of rotations is increased, kinetic energy E of the developer t is increased in proportion to the square of the rotation speed of the development sleeve 5 by the conveying force applied from the development sleeve 5. When the developer t whose kinetic energy is increased collides with the regulating member 16, the developer t is degraded. Therefore, the following equation (1) holds.

$$E=C(\text{constant})\times M(\text{mass})\times V(\text{speed})^2 \quad (1)$$

As can be seen from the equation (1), the developer t is rapidly degraded with the increasing rotation speed of the development sleeve 5. In other words, the number of speed reduction times can be decreased when the rotation speed of the development sleeve 5 is reduced. The rotation speed of the development sleeve 5 in the non-development time is reduced, and the number of speed reduction times is increased, whereby the variation in reflecting density can be improved.

Fourth Embodiment

Figure 7:
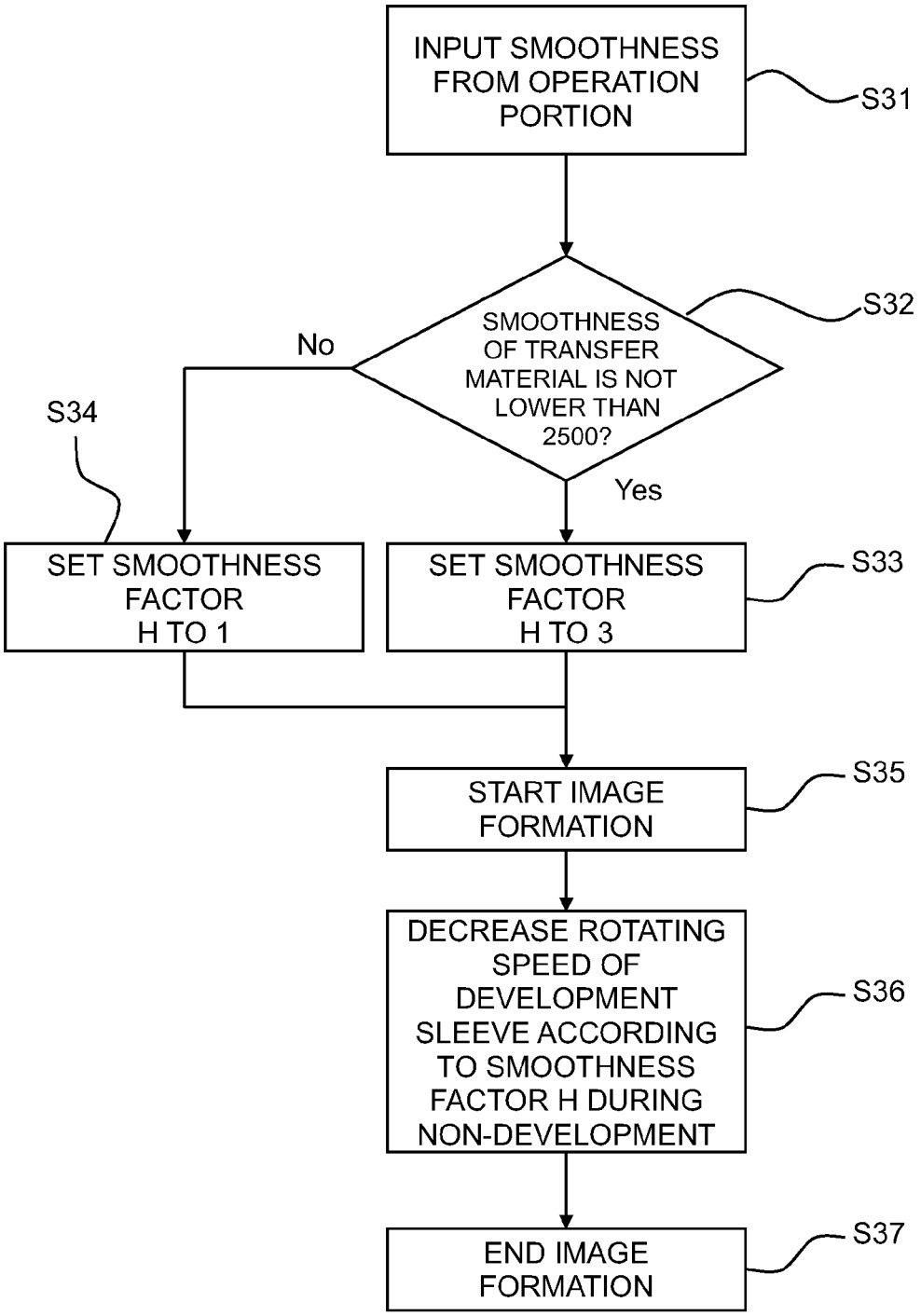
FIG. 7 is a flowchart illustrating a control process of an engine processing portion of an image forming apparatus according to a fourth embodiment of the invention.

FIG. 7 is a flowchart illustrating a control process of an engine processing portion 32 of an image forming apparatus according to a fourth embodiment of the invention. In the image forming apparatus of the fourth embodiment, the same configuration and effect as those of the image forming apparatus 13 of the first to third embodiments are designated by the same numerals, and the description will not be repeated. The image forming apparatus of the fourth embodiment differs from the image forming apparatus of the first to third embodiments in that the smoothness of the transfer material P is input from the operation portion 21 and the rotation speed of the development sleeve 5 in the non-development time is reduced based on the smoothness of the transfer material P. As used herein, the smoothness means a value of IS-P-8119 (for example, coated paper: 2500 (seconds)).

Specifically, the image forming apparatus of the fourth embodiment has the following features. The image forming apparatus includes the operation portion 21 from which the "smoothness" of the transfer material P is input and an engine processing portion 32 that is the "speed varying unit" being able to vary the rotation speed of the development sleeve 5. The engine processing portion 32 adjusts the rotation speed of the development sleeve 5 while keeping the rotation speed of the photosensitive drum 1 constant irrespective of the kind of the transfer material P. When the smoothness of the transfer material P is higher than a predetermined value, the engine processing portion 32 reduces the rotation speed of the development sleeve 5 in the non-development time when the electrostatic image absent region of the photosensitive drum 1 is not developed by the developer lower than the rotation speed of the development sleeve 5 in the non-development time when the smoothness of the transfer material P is smaller than the predetermined value. Similarly to the second embodiment, when the smoothness of the transfer material P is larger than the predetermined value, the control is performed such that the fixing temperature is set higher to widen the gap between the pieces of paper compared with the case in which the smoothness of the transfer material P is smaller than the predetermined value.

When the user inputs the surface state of the operation portion P from the operation portion 21 by the transfer material kind setting 22 (see FIG. 2) of the transfer material P, the engine processing portion 32 starts the control (S31). Specifically, the coated paper is selected when the transfer material P has the smooth surface, and the plain papers are selected when the transfer material P has the roughened surface.

The engine processing portion 32 determines whether the smoothness of the transfer material P is not lower than 2500 (S32). When determining that the smoothness of the transfer material P is not lower than 2500 (YES in S32), the engine processing portion 32 sets a smoothness factor H to 3 (S33). When the smoothness of the transfer material P is increased, the surface of the transfer material P becomes glazed. When determining that the smoothness of the transfer material P is lower than 2500 (NO in S32), the engine processing portion 32 sets the smoothness factor H to 1 (S34). When the smoothness of the transfer material P is decreased, the surface of the transfer material P becomes roughened. When the smoothness factor H is set to 3 or 1, the engine processing portion 32 computes the rotation speed of the development sleeve 5 in the non-development time based on the set smoothness factor H.

TABLE 6 shows a relationship among the smoothness of the transfer material P, the smoothness factor H, and the reduction of the rotation speed of the development sleeve 5 in the non-development time. The high smoothness of the transfer material P expresses the glazed surface of the transfer material P. Because the developer t hardly permeates the transfer material P, the necessary amount of heat for fixing is increased. Therefore, the developer t is easily degraded by the temperature rise inside of the apparatus main body 13A. The high smoothness of the transfer material P reduces the rotation speed of the development sleeve 5 in the non-development time.

TABLE 6

| | SMOOTHNESS | | | |
|---|---|---|---|---|
| | LOWER THAN 1500 | NOT LOWER THAN 1500 AND LOWER THAN 2000 | NOT LOWER THAN 2000 AND LOWER THAN 2500 | NOT LOWER THAN 2500 |
| SMOOTHNESS FACTOR (H) | 1 | 2 | 3 | 4 |
| COMPARATIVE EXAMPLE 1 | ABSENCE | ABSENCE | ABSENCE | ABSENCE |
| FOURTH EMBODIMENT | ABSENCE | SMALL | INTERMEDIATE | LARGE |

When the smoothness factor H is set to 3 or 1, the engine processing portion 32 starts the image formation based on the set smoothness factor H (S35). The engine processing portion 32 performs the control so as to reduce the rotation speed of the development sleeve 5 based on the smoothness factor H of the transfer material P (S36). The engine processing portion 32 ends the image formation (S37).

TABLE 7 shows experimental results of an image forming apparatus according to the comparative example 1 and the image forming apparatus of the fourth embodiment. In the fourth embodiment, for the smoothness of 2500, the rotation speed of the development sleeve 5 is reduced by 75% (large). As a result, for the large smoothness, the variation in density is reduced compared with the comparative example 1. The similar results are obtained in the embodiments.

TABLE 7

| | | CONTROL | | RESULT |
|---|---|---|---|---|
| | CONDITION SMOOTHNESS | REDUCTION OF ROTATION SPEED OF DEVELOPMENT SLEEVE (Δ) | TRANSFER MATERIAL KIND SETTING | VARIATION IN REFLECTING DENSITY (PER 10 kIMAGE) |
| COMPARATIVE EXAMPLE 1 | 1400 | ABSENCE | ABSENCE | ○ |
| | 2500 | ABSENCE | ABSENCE | x |
| FOURTH EMBODIMENT | 1400 | ABSENCE | PRESENCE | ○ |
| | 2500 | PRESENCE (LARGE) | PRESENCE | ○ |

Fifth Embodiment

Figure 8:
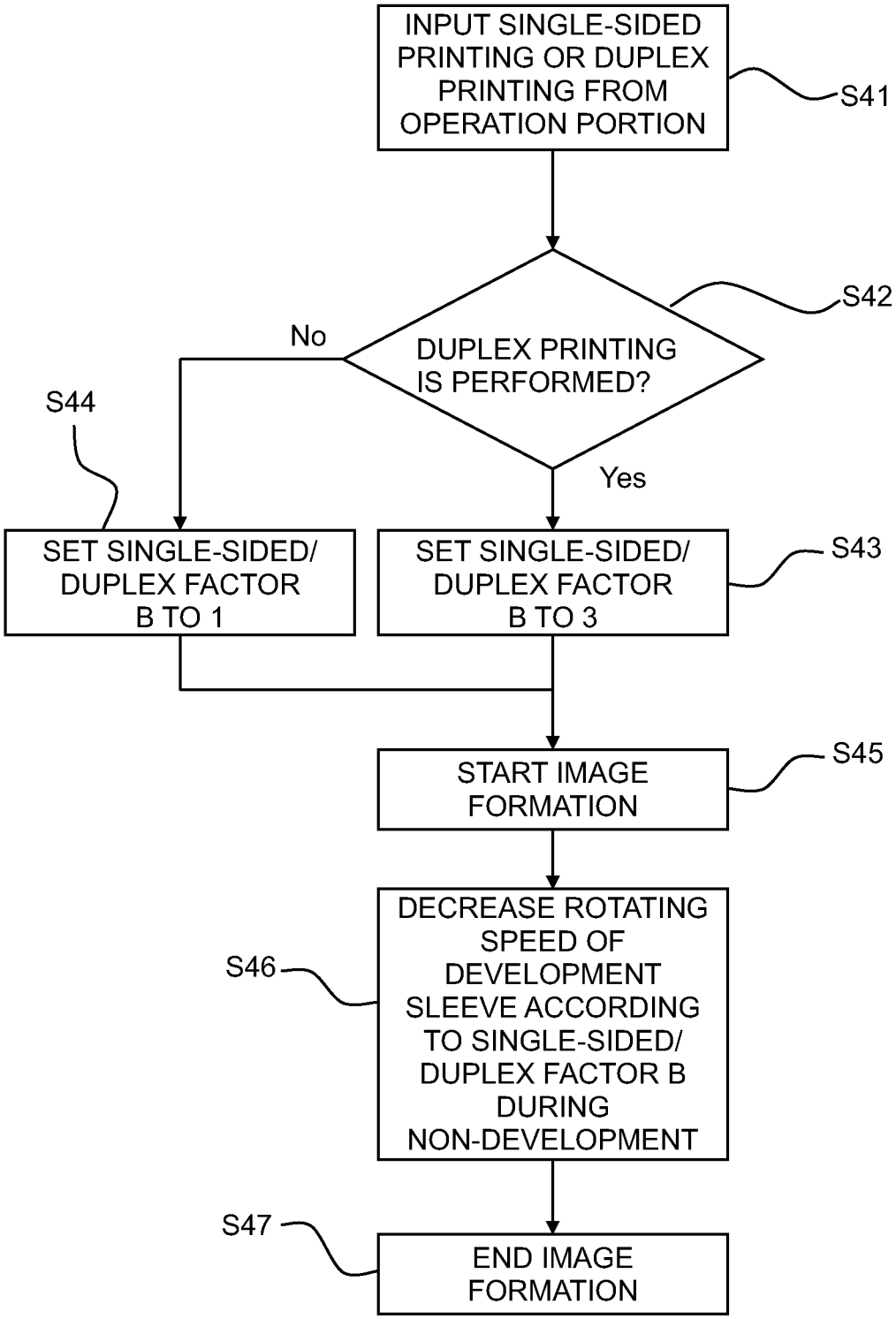
FIG. 8 is a flowchart illustrating a control process of an engine processing portion of an image forming apparatus according to a fifth embodiment of the invention.

FIG. 8 is a flowchart illustrating a control process of an engine processing portion 32 of an image forming apparatus according to a fifth embodiment of the invention. In the image forming apparatus 13 of the fifth embodiment, the same configuration and effect as those of the image forming apparatus 13 of the first to fourth embodiments are designated by the same numerals, and the description will not be repeated. The image forming apparatus of the fifth embodiment differs from the image forming apparatus of the first to fourth embodiments in that whether the image formation is performed in the single-sided mode or the duplex mode is input from the operation portion 21 to reduce the rotation speed of the development sleeve 5 in the non-development time.

Specifically, the image forming apparatus of the fifth embodiment has the following features. The image forming apparatus includes the operation portion 21 and the engine processing portion 32. The transfer surface number information on the number of surfaces of the duplex or single-sided transfer material P subjected to the transfer is input from the operation portion 21. The engine processing portion 32 that is the "speed varying unit" being able to vary the rotation speed of the development sleeve 5. The engine processing portion 32 adjusts the rotation speed of the development sleeve 5 while keeping the rotation speed of the photosensitive drum 1 constant irrespective of the kind of the transfer material P. When the duplex printing is performed to the transfer material P, compared with the single-sided printing, the rotation speed of the development sleeve 5 in the non-development time when the electrostatic image absent region of the photosensitive drum 1 is not developed by the developer is reduced lower than the rotation speed of the development sleeve 5 in the development time when the electrostatic image of the photosensitive drum 1 is developed by the developer.

When the user inputs whether the image formation is performed to the single-sided mode or the duplex mode by the single-sided/duplex setting 24 from the operation portion 21, the engine processing portion 32 starts the control (S41). The engine processing portion 32 determines whether the duplex printing is performed (S42). When determining that the duplex printing is performed (YES in S42), the single-sided/duplex factor B is set to 3 (S43). When determining that the single-sided printing is performed (NO in S42), the single-sided/duplex factor B is set to (S44). When the single-sided/duplex factor B is set to 3 or 1, the engine processing portion 32 computes the rotation speed of the development sleeve 5 in the non-development time based on the set single-sided/duplex factor B.

TABLE 8 shows a relationship among the single side or duplex of the transfer material P, the single-sided/duplex factor B, and the reduction of the rotation speed of the development sleeve 5 in the non-development time. For the duplex printing, because the transfer material P having the amount of heat in passing through the fixing device 10 once passes through the apparatus main body 13A again, the temperature of the apparatus main body 13A rises, thereby degrading the developer t. Therefore, in the fifth embodiment, for the duplex printing, the rotation speed of the development sleeve 5 in the non-development time is reduced lower than that of the single-sided printing. The reduction of the rotation speed of the development sleeve 5 in the non-development time is "intermediate" in which the rotation speed of the development sleeve 5 is 50% of the usual rotation speed. Other study conditions are similar to those of second embodiment.

TABLE 8

| | SINGLE-SIDE/DUPLEX | |
|---|---|---|
| | SINGLE-SIDED | DUPLEX |
| SINGLE-SIDED/DUPLEX FACTOR (B) | 1 | 3 |
| COMPARATIVE EXAMPLE 1 | ABSENCE | ABSENCE |
| FIFTH EMBODIMENT | ABSENCE | INTERMEDIATE |

When the single-sided/duplex factor B is set to 3 or 1, the engine processing portion 32 starts the image formation based on the set single-sided/duplex factor B (S45). The engine processing portion 32 performs the control based on the single-sided/duplex factor B of the transfer material P so as to reduce the rotation speed of the development sleeve 5 in the non-development time (S46). The engine processing portion 32 ends the image formation (S47).

TABLE 9 shows experimental results of the image forming apparatus according to the comparative example 1 and the image forming apparatus of the fifth embodiment. As can be seen from TABLE 9, for the duplex printing, the variation in density is reduced by increasing the reduction of the rotation speed of the development sleeve 5 compared with the comparative example 1. The similar results are obtained in the embodiments.

TABLE 9

| | | CONTROL | | RESULT |
|---|---|---|---|---|
| | CONDITION PAPER PASSAGE METHOD | REDUCTION OF ROTATION SPEED OF DEVELOPMENT SLEEVE (Δ) | SINGLE-SIDED/ DUPLEX SETTING | VARIATION IN REFLECTING DENSITY (PER 10 kIMAGE) |
| COMPARATIVE EXAMPLE 1 | SINGLE-SIDED | ABSENCE | ABSENCE | ○ |
| | DUPLEX | ABSENCE | ABSENCE | x |
| FIFTH EMBODIMENT | SINGLE-SIDED | ABSENCE | PRESENCE | ○ |
| | DUPLEX | PRESENCE (INTERMEDIATE) | PRESENCE | ○ |

Figure 10:
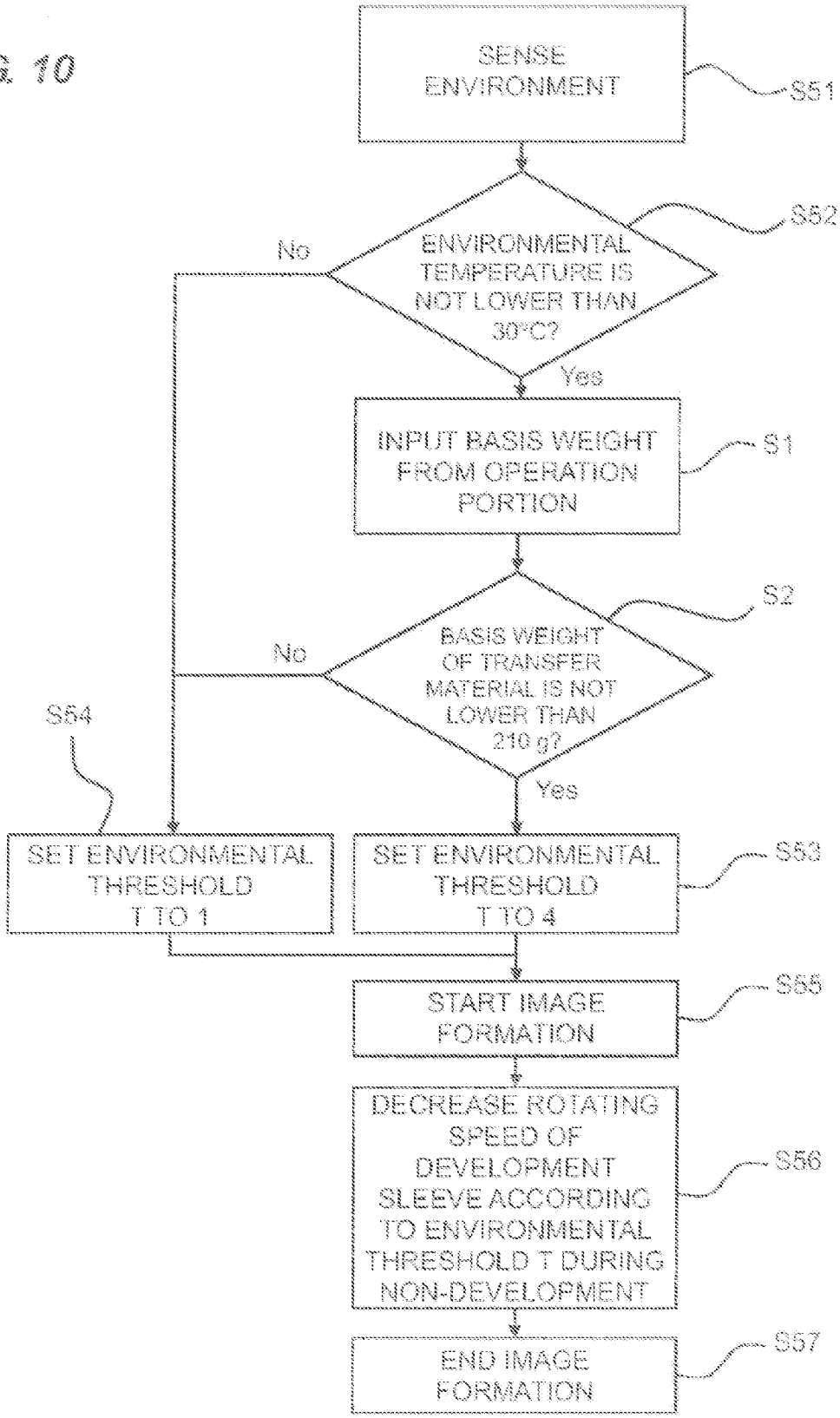
FIG. 10 is a flowchart illustrating a control process of an engine processing portion of an image forming apparatus according to a modification.
Figure 11:
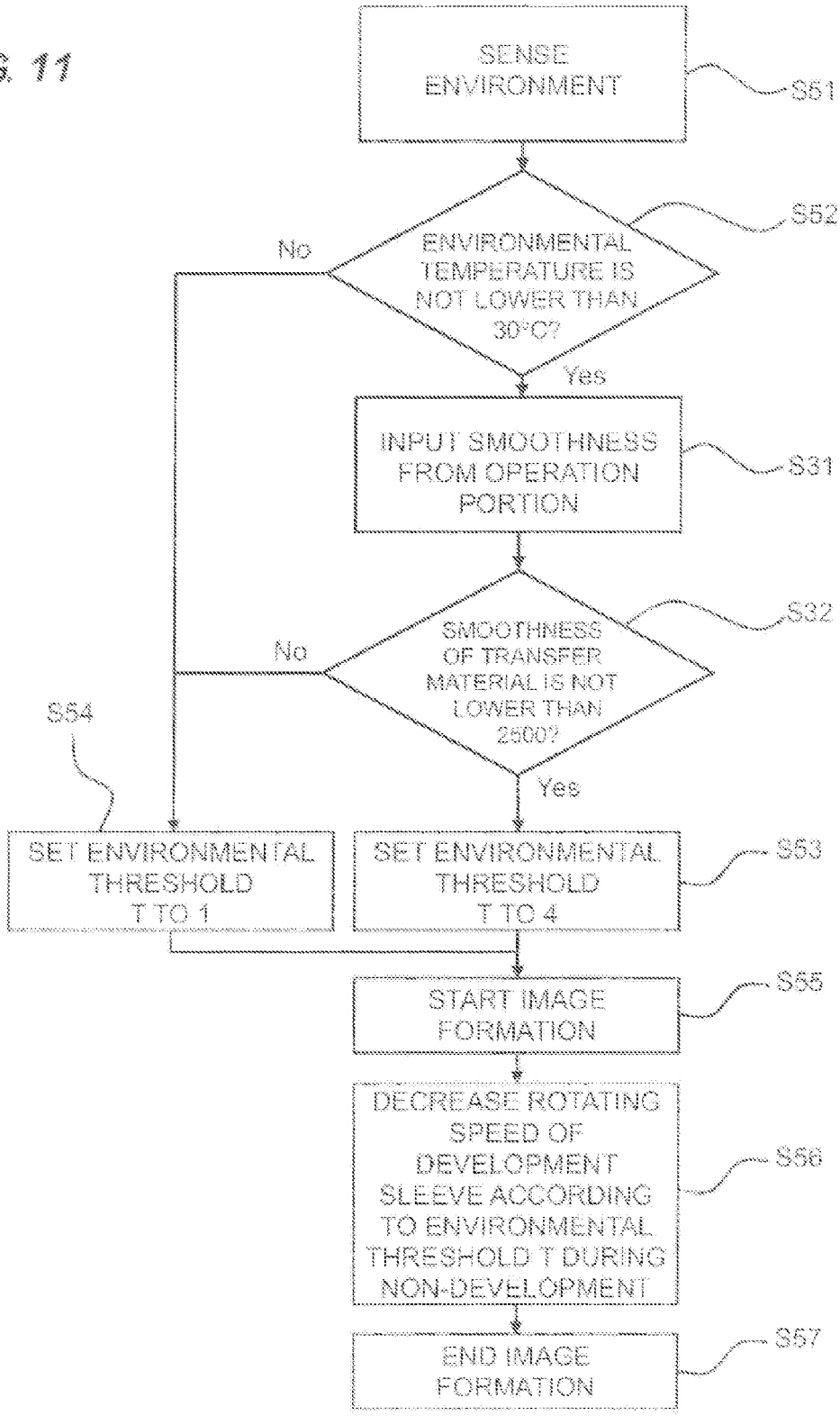
FIG. 11 is a flowchart illustrating a control process of an engine processing portion of an image forming apparatus according to another modification.
Figure 12:
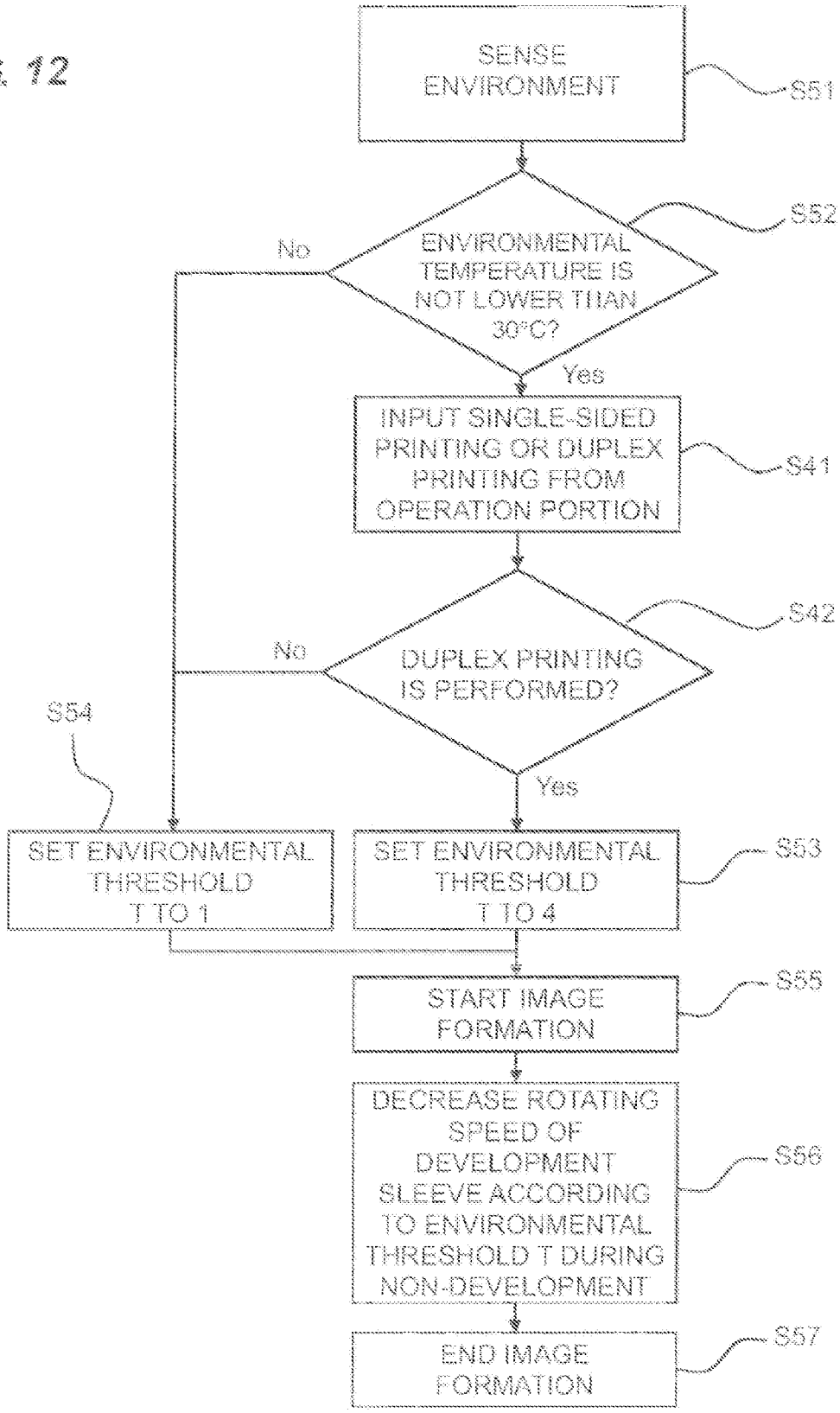
FIG. 12 is a flowchart illustrating a control process of an engine processing portion of an image forming apparatus according to yet another modification.

According to the image forming apparatus of the first embodiment, the engine processing portion 32 that is the "speed varying unit" reduces the rotation speed of the development sleeve 5 in the "non-development time" lower than the rotation of the development sleeve 5 in the "development time" when the environmental temperature of the transfer material P is higher than the predetermined value. Accordingly, the toner refresh period is shortened to reduce the consumed amount of toner, and the time the development sleeve 5 rotates while the toner is not consumed is shortened. As a result, the exchange frequency of the toner recycling container is decreased, and the image quality degradation caused by the toner degradation is suppressed. As a result, the fixing characteristic of the developer t with respect to the transfer material P and the image quality of the print are maintained for a long time. At the same time, the engine processing portion 32 that is the "speed varying unit" keeps (maintains) the rotation speed of the photosensitive drum 1 constant irrespective of the kind of the transfer material P. When the image formation is performed at different environmental temperatures, the decrease of the print productivity is suppressed because the rotation speed of the photosensitive drum 1 is kept constant. When the image formation is performed at a high environmental temperature, the reduction of the rotation speed of the photosensitive drum 1 decreases the print productivity. In the first embodiment, the mode in which the rotation speed of the development sleeve 5 is reduced in the non-development time is always performed at the high environmental temperature. However, the mode in which the rotation speed of the development sleeve 5 is reduced in the non-development time can be selected even at the high environmental temperature according to other conditions such as, e.g., basis weight of the transfer material (FIG. 10), smoothness of the transfer material (FIG. 11), or single-sided/duplex printing (FIG. 12).

The same holds true for the case in which the smoothness is higher than the predetermined value in the fourth embodiment and the duplex printing of the fifth embodiment. The same holds true for the case in which the number of speed-reduction times is increased in the third embodiment and the basis weight is larger than the predetermined value of the second embodiment. That is, the rotation speed of the development sleeve 5 in the "non-development time" is reduced lower than the rotation speed of the development sleeve 5 in the "development time". Accordingly, the toner refresh period is shortened to reduce the consumed amount of toner, and the time the development sleeve 5 rotates while the toner is not consumed is shortened. As a result, the exchange frequency of the toner recycling container is decreased, and the image quality degradation caused by the toner degradation is suppressed. As a result, the fixing characteristic of the developer t with respect to the transfer material P and the image quality of the print are maintained for a long time. The fixed rotation speed of the photosensitive drum 1 also has the above-described effect.

Figure 9:
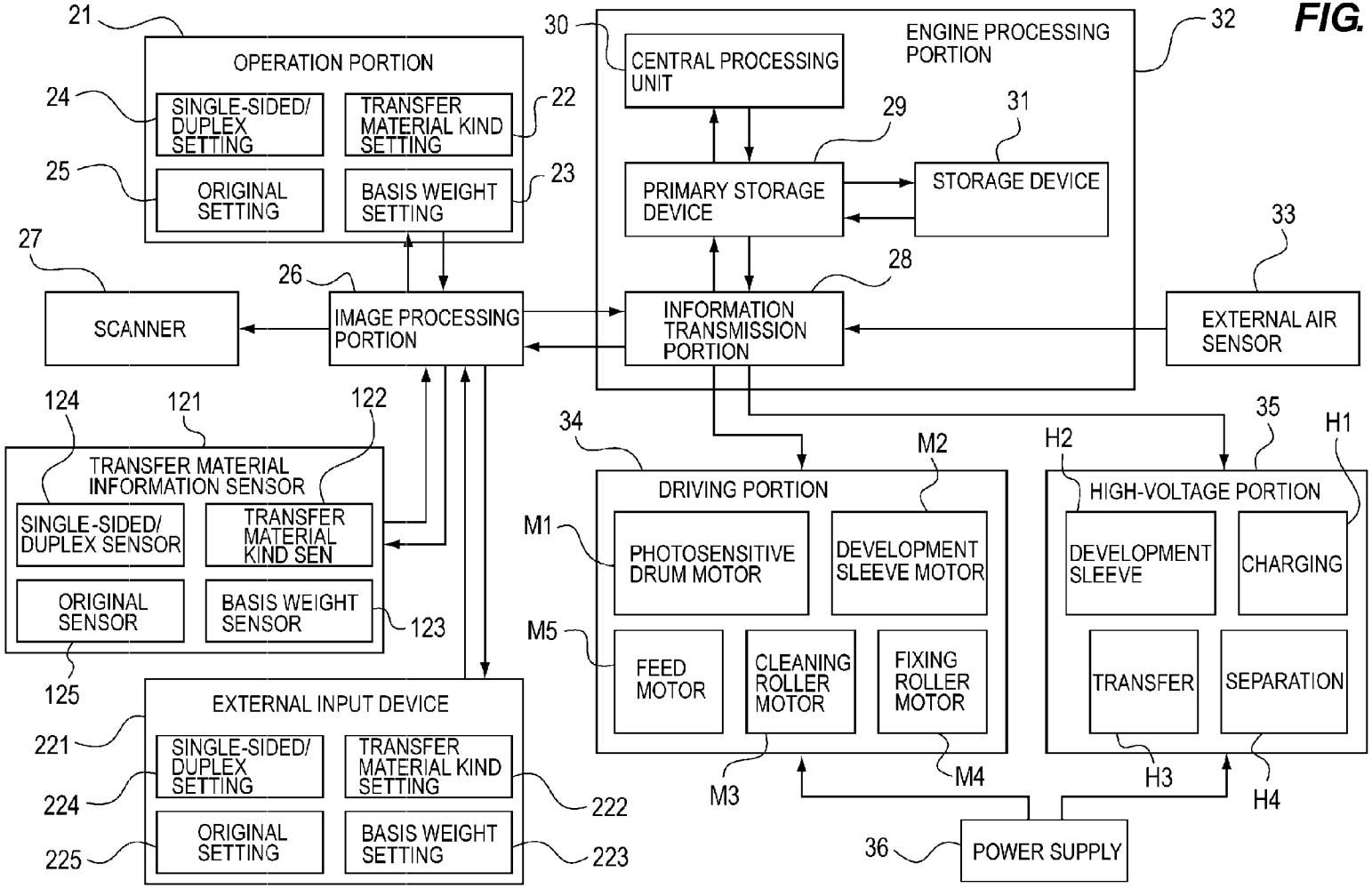
FIG. 9 is a block diagram illustrating signal transmission of an image forming apparatus according to a modification.

FIG. 9 is a block diagram illustrating signal transmission of an image input/output apparatus 113 according to a modification. As illustrated in FIG. 9, instead of the operation portion 21, a transfer material information sensor 121 that senses the information on the transfer material P may be provided to replace the function of the operation portion 21. Instead of the operation portion 21, an external input device 221 to which the information on the transfer material P is input may be provided to replace the function of the operation portion 21. A part or all of the operation portion 21, the transfer material information sensor 121, and the external input device 221 may be provided. A personal computer connected to the image forming apparatus can be cited as an example of the external input device 221.

The transfer material information sensor 121 that is the "input portion" may include an original sensor 125 that senses the original printed by the user, a basis weight sensor 123, a transfer material kind sensor 122, and a single-sided/duplex sensor 124 that senses the print mode. The information on the "basis weight" of the transfer material P is input to the basis weight sensor 123 of the transfer material information sensor 121. The information on the "smoothness" of the transfer material P is input to the transfer material kind sensor 122 of the transfer material information sensor 121. The "transfer surface number information on the number of surfaces of the duplex or single-sided transfer material P subjected to the transfer" is input to the single-sided/duplex sensor 124 of the transfer material information sensor 121. At this point, the engine processing portion 32 adjusts the rotation speed of the development sleeve 5 based on the sensing result of the transfer material information sensor 121.

The external input device 221 that is the "input portion" may include an original setting 225 in which the original printed by the user is set, a basis weight setting 223, a transfer material kind setting 222, a single-sided/duplex setting 224 in which the print mode is set. The output information on the "basis weight" of the transfer material P is input to the basis weight setting 223 of the external input device 221. The information on the "smoothness" of the transfer material P is input to the transfer material kind setting 222 of the external input device 221. The "transfer surface number information on the number of surfaces of the duplex or single-sided transfer material P subjected to the transfer" is input to the single-sided/duplex setting 224 of the external input device 221.

The "image forming apparatus" is a concept including not only the image forming apparatus, but also the image forming apparatus and the external input device 221 when the external input device 221 is disposed outside the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-055865, filed Mar. 12, 2010, which is hereby incorporated by reference herein in its entirety.

What is claimed is:

1. An image forming apparatus comprising:

an image bearing member on which an electrostatic image is formed;

a development device that has a developer bearing member capable of bearing a developer and develops the electrostatic image at a developing region;

a sensing portion that senses an environmental temperature around the development device; and a controller that can perform a mode in which, during a continuous image forming job in which a plurality of recording materials are continuously image-formed, in a developing period that an image forming area of the image bearing member corresponding to recording material passes the developing region, the controller drives the developer bearing member at a first rotating speed, and in at least a part of a non-developing period that a non-image forming area of the image bearing member corresponding to an area between recording materials passes the developing region, the controller drives the developer bearing member at a second rotating speed which is slower than the first rotating speed, wherein based on a sensing result of the sensing portion, the controller decides to perform the mode or not to perform the mode.

2. The image forming apparatus according to claim 1, wherein the controller performs the mode when the environmental temperature around the development device is not lower than a predetermined value, and the controller controls the rotation speed of the developer bearing member in the developing period the same as in the non-developing period when the environmental temperature around the development device is lower than the predetermined value.

3. The image forming apparatus according to claim 1, further comprising:

an input portion to which information on a basis weight of the transfer material is input, wherein the controller decides to perform the mode or not to perform the mode based on the information input at the input portion.

4. The image forming apparatus according to claim 1, further comprising:

an input portion to which information on smoothness of the transfer material is input; and wherein the controller decides to perform the mode or not to perform the mode based on the information input at the input portion.

5. The image forming apparatus according to claim 1, further, comprising:

an input portion to which transfer surface number information on the number of surfaces of the transfer material subjected to the transfer is input; and wherein the controller decides to perform the mode or not to perform the mode based on the information input at the input portion.

6. An image forming apparatus comprising:

an image bearing member on which an electrostatic image is formed;

a development device that develops the electrostatic image at a developing region;

a sensing portion that senses an environmental temperature around the development device; and a controller that can perform a mode in which during a continuous image forming job in which a plurality of recording materials are continuously image-formed, in a developing period that an image forming area of the image bearing member corresponding to recording material passes the developing region, the controller drives the developer bearing member at a predetermined rotating speed, and in at least a part of a non-developing period that a non-image forming area of the image bearing member corresponding to an area between recording materials passes the developing region, the controller stops driving the developer bearing member, wherein based on a sensing result of the sensing portion, the controller decides to perform the mode or not to perform the mode.

7. The image forming apparatus according to claim 6, wherein the controller performs the mode when the environmental temperature around the development device is not lower than a predetermined value, and the controller controls the rotation speed of the developer bearing member in the developing period the same as in the non-developing period when the environmental temperature around the development device is lower than the predetermined value.

8. The image forming apparatus according to claim 6, further comprising:

an input portion to which information on a basis weight of the transfer material is input, wherein the controller decides to perform the mode or not to perform the mode based on the information input at the input portion.

9. The image forming apparatus according to claim 6, further comprising:

an input portion to which information on smoothness of the transfer material is input, wherein the controller decides to perform the mode or not to perform the mode based on the information input at the input portion.

10. The image forming apparatus according to claim 6, further comprising:

an input portion to which transfer surface number information on the number of surfaces of the transfer material subjected to the transfer is input, wherein the controller decides to perform the mode or not to perform the mode based on the information input at the input portion.

* * * * *